US011120760B2

(12) United States Patent
Nakanishi et al.

(10) Patent No.: US 11,120,760 B2
(45) Date of Patent: Sep. 14, 2021

(54) LIQUID CRYSTAL DISPLAY DEVICE

(71) Applicants: Panasonic Liquid Crystal Display Co., Ltd., Himeji (JP); Pasona Knowledge Partner Inc., Osaka (JP)

(72) Inventors: Hideyuki Nakanishi, Osaka (JP); Katsuhiro Kikuchi, Osaka (JP); Takenobu Nishiguchi, Nara (JP); Tatsuo Itoman, Osaka (JP)

(73) Assignees: PANASONIC LIQUID CRYSTAL DISPLAY CO., LTD., Hyogo (JP); PASONA KNOWLEDGE PARTNER INC., Osaka (JP)

( * ) Notice: Subject to any disclaimer, the term of this patent is extended or adjusted under 35 U.S.C. 154(b) by 0 days.

(21) Appl. No.: 17/101,999

(22) Filed: Nov. 23, 2020

(65) Prior Publication Data

US 2021/0201836 A1 Jul. 1, 2021

(30) Foreign Application Priority Data

Dec. 25, 2019 (JP) ..... JP2019-233712

(51) Int. Cl.
*G09G 3/36* (2006.01)

(52) U.S. Cl.
CPC ..... *G09G 3/3648* (2013.01); *G09G 2300/023* (2013.01); *G09G 2320/0233* (2013.01); *G09G 2320/0276* (2013.01); *G09G 2340/16* (2013.01)

(58) Field of Classification Search
CPC ..... G09G 3/3648; G09G 2320/0233; G09G 2320/0276; G09G 2340/16; G09G 2300/023
See application file for complete search history.

(56) References Cited

U.S. PATENT DOCUMENTS

| | | | | |
|---|---|---|---|---|
| 9,666,121 | B2 * | 5/2017 | Aoyama | H01L 27/322 |
| 10,916,207 | B1 * | 2/2021 | Cong | G02F 1/1347 |
| 11,011,113 | B1 * | 5/2021 | Lu | G09G 3/325 |
| 2009/0147186 | A1 | 6/2009 | Nakai et al. | |
| 2012/0133673 | A1 * | 5/2012 | Ninan | H05B 45/20 345/599 |
| 2015/0356914 | A1 * | 12/2015 | Aoyama | G09G 3/3208 345/690 |
| 2018/0031897 | A1 * | 2/2018 | Kikuchi | G02F 1/133528 |

(Continued)

FOREIGN PATENT DOCUMENTS

WO 2007/040127 4/2007

*Primary Examiner* — Dmitriy Bolotin

(74) *Attorney, Agent, or Firm* — Hamre, Schumann, Mueller & Larson, P.C.

(57) ABSTRACT

A liquid crystal display device includes: first and second liquid crystal panels disposed to be overlapped with each other; a parallax reduction unit that generates the second output image signal by performing smoothing processing on a first signal based on the input image signal; a first temporal filter that generates a first response correction signal determining the first output image signal based on the second output image signal; and a corrector that generates the first output image signal based on at least the first response correction signal and a second signal based on the input image signal. The first temporal filter generates the first response correction signal of a current frame based on the second output image signal of the current frame and the first response correction signal of a previous frame.

13 Claims, 24 Drawing Sheets

(56) References Cited

U.S. PATENT DOCUMENTS

| | | | | |
|---|---|---|---|---|
| 2018/0151103 | A1* | 5/2018 | Koudo | G09G 3/36 |
| 2018/0286325 | A1* | 10/2018 | Koudo | G06T 5/20 |
| 2019/0066609 | A1* | 2/2019 | Hirotsune | G09G 3/3648 |
| 2019/0139500 | A1* | 5/2019 | Tada | G09G 3/36 |
| 2019/0147812 | A1* | 5/2019 | Koudo | G02F 1/133512 345/84 |
| 2020/0175934 | A1* | 6/2020 | Hirotsune | G09G 3/3607 |
| 2020/0175946 | A1* | 6/2020 | Nakanishi | G06T 5/50 |

* cited by examiner

FIG. 5

| | | output value before one frame | | | | |
|---|---|---|---|---|---|---|
| | | 0 | 0.25 | 0.5 | 0.75 | 1 |
| input value | 0 | | | | | |
| | 0.25 | | | | | |
| | 0.5 | | | | | |
| | 0.75 | | | | | |
| | 1 | | | | | |

output value

LIQUID CRYSTAL DISPLAY DEVICE

CROSS-REFERENCE TO RELATED APPLICATION

This application claims priority from Japanese application JP 2019-233712, filed on Dec. 25, 2019. This Japanese application is incorporated herein by reference.

TECHNICAL FIELD

The present invention relates to a liquid crystal display device.

BACKGROUND

Liquid crystal display devices employing a liquid crystal panel can display images with low power consumption, and thus are utilized as displays, such as televisions or monitors, for example. However, liquid crystal display devices have low contrast ratios, as compared to organic electro luminescent (EL) display devices.

Thus, a liquid crystal display device is proposed in which liquid crystal panels are overlaid one on top of another to allow display of an image having a contrast ratio that is comparable to or more than organic EL display devices. For example, International publication No. 2007/040127 discloses an image display device which achieves an improved contrast ratio by overlaying a first liquid crystal panel which displays a color image and a second liquid crystal panel which displays a monochrome image.

SUMMARY

However, in the liquid crystal display device disclosed in International publication No. 2007/040127, image quality can be reduced.

This present disclosure provides a liquid crystal display device which inhibit the reduction of image quality.

a liquid crystal display device according to a present disclosure includes: a first liquid crystal panel; a second liquid crystal panel disposed to be superposed on the first liquid crystal panel; and an image processor that generates a first output image signal output to the first liquid crystal panel and a second output image signal output to the second liquid crystal panel based on an input image signal, wherein the image processor includes: a first parallax reduction unit that receives a first signal based on the input image signal, and generates the second output image signal by performing smoothing processing on the first signal; a first temporal filter that receives the second output image signal, and generates a first response correction signal determining the first output image signal based on the second output image signal; and a corrector that receives at least the first response correction signal and a second signal based on the input image signal, and generates the first output image signal based on at least the first response correction signal and the second signal, and the first temporal filter generates the first response correction signal of a current frame based on the second output image signal of the current frame and the first response correction signal of a previous frame.

BRIEF DESCRIPTION OF THE DRAWINGS

FIG. 5 is a view illustrating an example of a look-up table included in a temporal filter of the first exemplary embodiment;

DETAILED DESCRIPTION (Knowledge Forming Basis of the Present Disclosure)

Knowledge forming a basis of the present disclosure will be described prior to the description of embodiments of the present disclosure.

Figure 21:
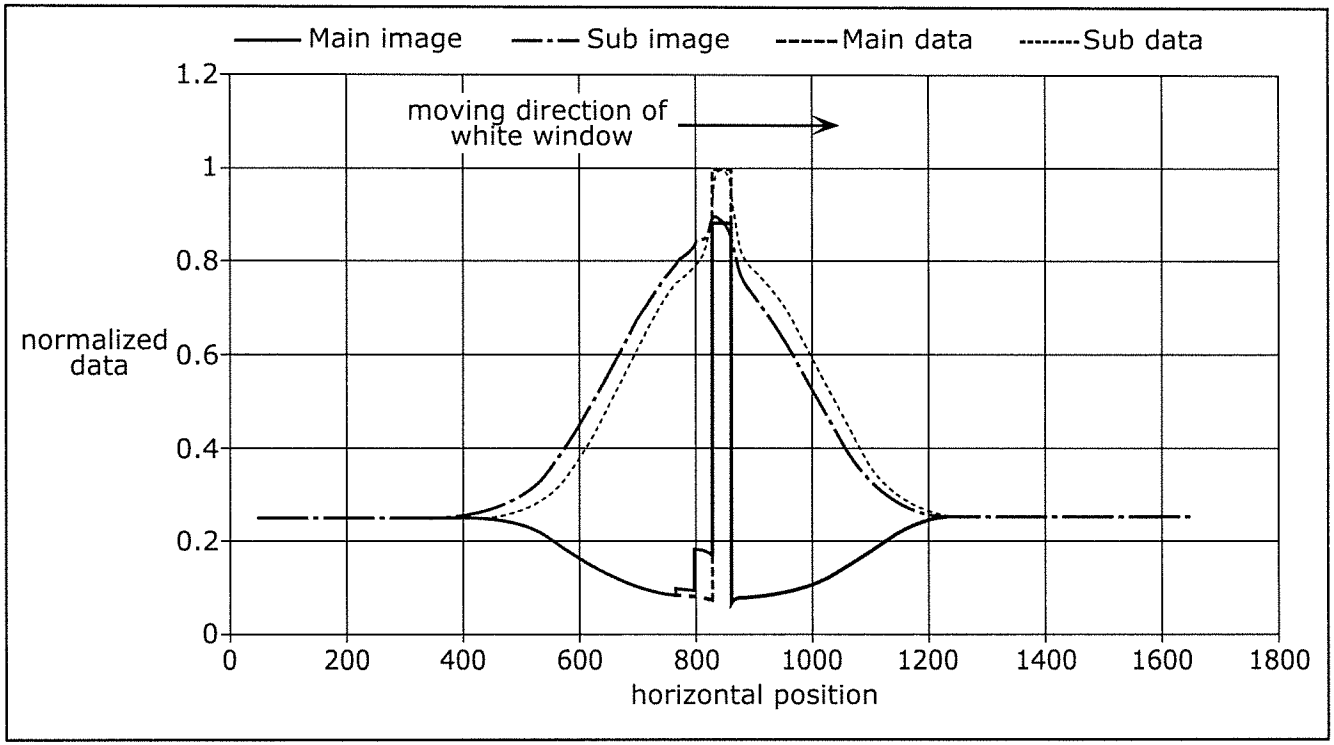
FIG. 21 is a first view illustrating degradation of image quality due to a difference in response speed.
Figure 22:
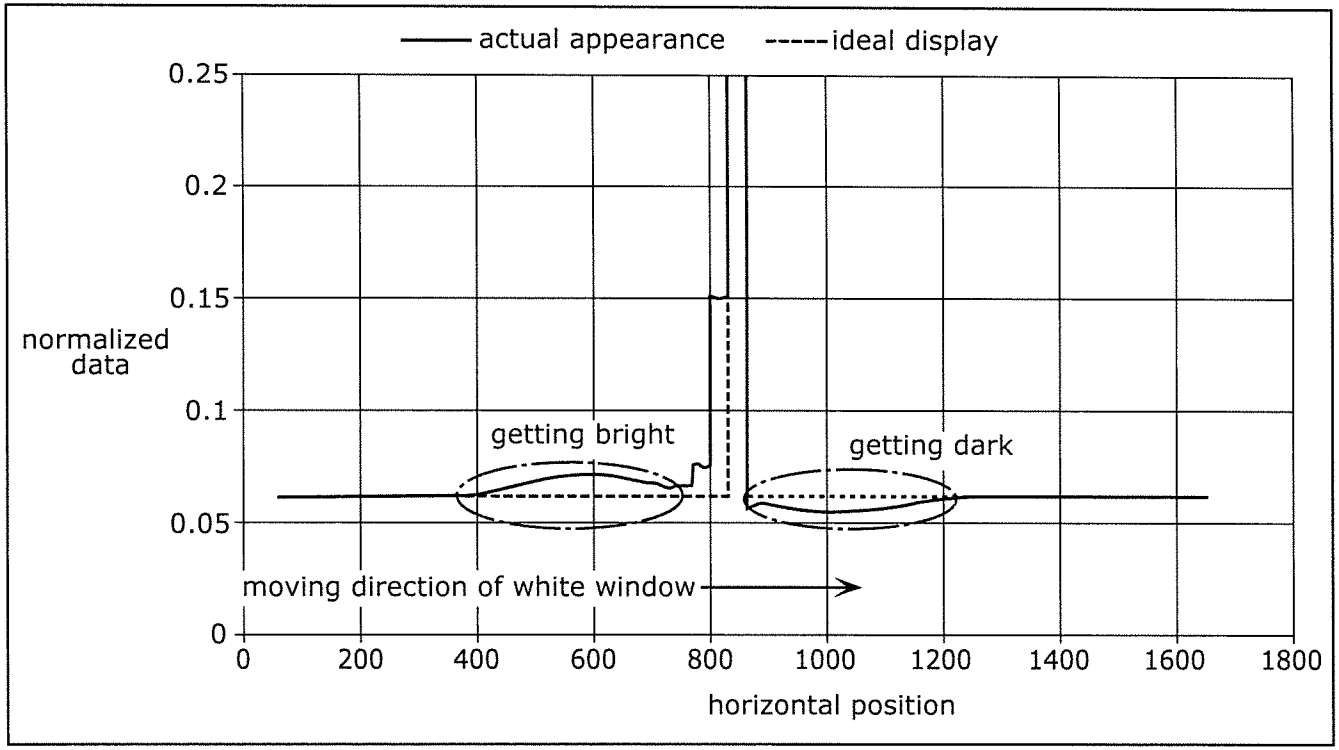
FIG. 22 is a second view illustrating the degradation of the image quality due to the difference in response speed.
Figure 23:
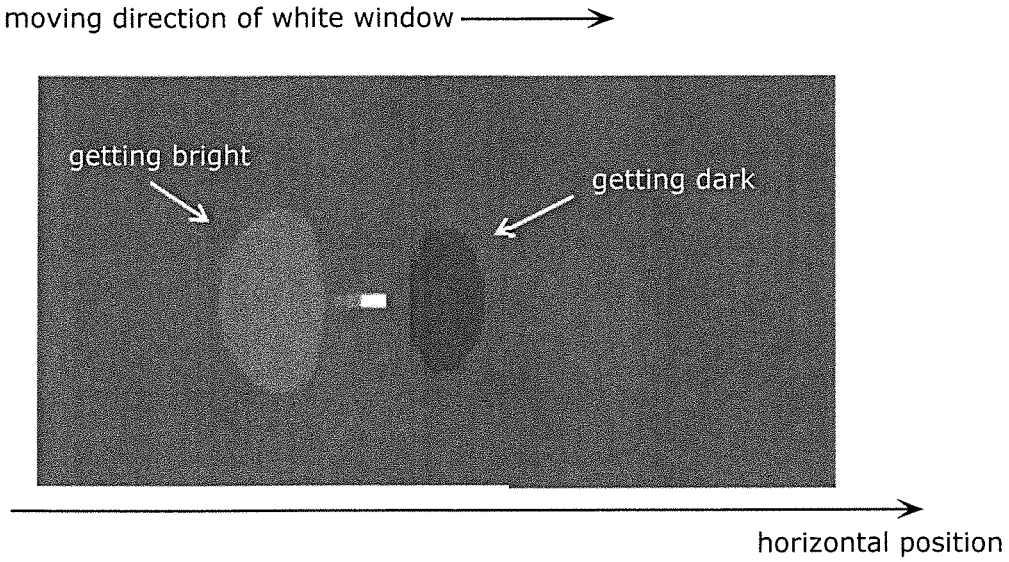
FIG. 23 is a third view illustrating the degradation of the image quality due to the difference in response speed.

As described in "Description of the Related Art", the liquid crystal display device that displays the image using a plurality of liquid crystal panels (for example, the first liquid crystal panel and the second liquid crystal panel) has been proposed in order to improve the contrast ratio. In the liquid crystal display device, sometimes the first liquid crystal panel and the second liquid crystal panel having different response speeds from each other is used. When the response speeds of the first liquid crystal panel and the second liquid crystal panel differ from each other, sometimes image quality of the displayed image is degraded. For example, sometimes a flicker (luminance fluctuation), luminance unevenness, and the like are generated in a moving image. With reference to FIGS. 21 to 23, the degradation of the image quality due to the difference in response speed will be described below. In the following description, it is assumed that the first liquid crystal panel is a main panel that displays a color image, and that the second liquid crystal panel is a sub panel that displays a monochrome image. It is also assumed that the response speed of the second liquid crystal panel is lower than the response speed of the first liquid crystal panel.

FIG. 21 is a first view illustrating the degradation of the image quality due to the difference in response speed. More specifically, FIG. 21 illustrates data (main data and sub data in FIG. 21) of image signals input to the first liquid crystal panel and the second liquid crystal panel and data (a main image and a sub image in FIG. 21) of an actual image at that time. The main data is data of an image signal input to the first liquid crystal panel, and the sub data is data of an image signal input to the second liquid crystal panel. The main image is data of actual brightness of the first liquid crystal panel when the main data is input, and the sub image is data of the actual brightness of the second liquid crystal panel when the sub data is input.

A horizontal axis in FIG. 21 indicates a horizontal position (a pixel position in a horizontal direction), and a vertical axis indicates normalized brightness (gradation value). FIG. 21 illustrates the image signal data and the image data at a certain moment in the moving image in which a window pattern having a bright rectangular range is scrolled rightward on a paper plane.

As illustrated in FIG. 21, in the first liquid crystal panel having the fast response speed, the input main data and the actually-displayed image have approximately the same brightness. On the other hand, in the second liquid crystal panel having the slow response speed, the actual image is darker than the sub data on the right side of horizontal position 850, and the actual image is brighter than the sub data on the left side of horizontal position 850. That is, the second liquid crystal panel becomes darker with respect to the sub data on the moving direction side of the window pattern, and becomes brighter with respect to the sub data on the opposite side to the moving direction of the window pattern.

With reference to FIGS. 22 and 23, an image visually recognized on the liquid crystal display device when the main image and the sub image are as illustrated in FIG. 21 will be described. FIG. 22 is a second view illustrating the degradation of the image quality due to the difference in response speed. Specifically, FIG. 22 illustrates an image (ideal display in FIG. 22) to be originally displayed by the image signal and an actual image (a combined image of the main image and the sub image in FIG. 21, and actual appearance in FIG. 22). FIG. 23 is a third view illustrating the degradation of the image quality due to the difference in response speed. Specifically, FIG. 23 is a view schematically illustrating a display image (combined image) displayed on the liquid crystal display device. In FIG. 23, a bright portion and a dark portion are exaggerated for easy understanding of the bright and dark portions.

As illustrated in FIGS. 22 and 23, the display image of the liquid crystal display device is dark on the moving direction side of the window pattern, and is bright on the opposite side to the moving direction of the window pattern. That is, the luminance unevenness has generated in the display image. Consequently, the image quality of the liquid crystal display device is degraded.

When the display image changes such that the window pattern disappears from a displayed state, sometimes the flicker in which the brightness surrounding the window pattern behaves differently from other portions is generated. This also degrades the image quality of the liquid crystal display device.

In order to prevent the degradation of the image quality due to the difference in response speed between the liquid crystal panels, it is studied that overdrive or underdrive is applied to signals input to the first liquid crystal panel and the second liquid crystal panel. For example, when the response speed of the second liquid crystal panel is slower than that of the first liquid crystal panel, it is studied that the signal input to the second liquid crystal panel is overdriven to match the response speed of the second liquid crystal panel with that of the first liquid crystal panel. In this case, there is a limitation to a matching amount of the response speed. For example, when the response speed of the first liquid crystal panel is faster than that of the second liquid crystal panel by a frame longer than one frame, the response speed of the second liquid crystal panel cannot be matched with that of the first liquid crystal panel. For example, when the response speed of the second liquid crystal panel is slower than that of the first liquid crystal panel, it is studied that the signal input to the first liquid crystal panel is underdriven to match the response speed of the first liquid crystal panel with that of the second liquid crystal panel. In this case, because the response speed of the first liquid crystal panel is decreased, for example, a blur (afterimage) may be seen in the moving image.

As described above, in the conventional method, the degradation of the image quality due to the difference in response speed cannot appropriately be prevented. For this reason, the inventors of the present disclosure have conducted intensive studies on the prevention of the degradation of the image quality due to the difference in response speed, and have devised the following liquid crystal display device.

Hereinafter, exemplary embodiments and the like will be described with reference to the drawings. The following exemplary embodiments provide comprehensive or specific examples of the present disclosure. Numerical values, shapes, materials, components, disposition positions of the components, connection modes of the components, steps, and order of the steps that are illustrated in the following exemplary embodiments are examples, and therefore are not intended to limit the present disclosure. Among the components in the following exemplary embodiments, the components that are not recited in the independent claims indicating the broadest concept are described as an optional component.

In the specification, the term, such as orthogonal, which indicates a relationship between elements, the term, such as rectangular, which indicates a shape of the element, a numerical value, and a numerical range are not equation of only a strict meaning, but equation of a meaning including a substantially equivalent range, for example, a difference of about several percent.

The drawings are schematic diagrams, and not necessarily strictly illustrated. In the drawings, substantially the same configuration is designated by the same reference numerals, and overlapping description will be omitted or simplified.

First Exemplary Embodiment

Liquid crystal display device 10 according to a first exemplary embodiment will be described below with reference to FIGS. 1 to 13.

[1-1. Configuration of Liquid Crystal Display Device]

Figure 1:
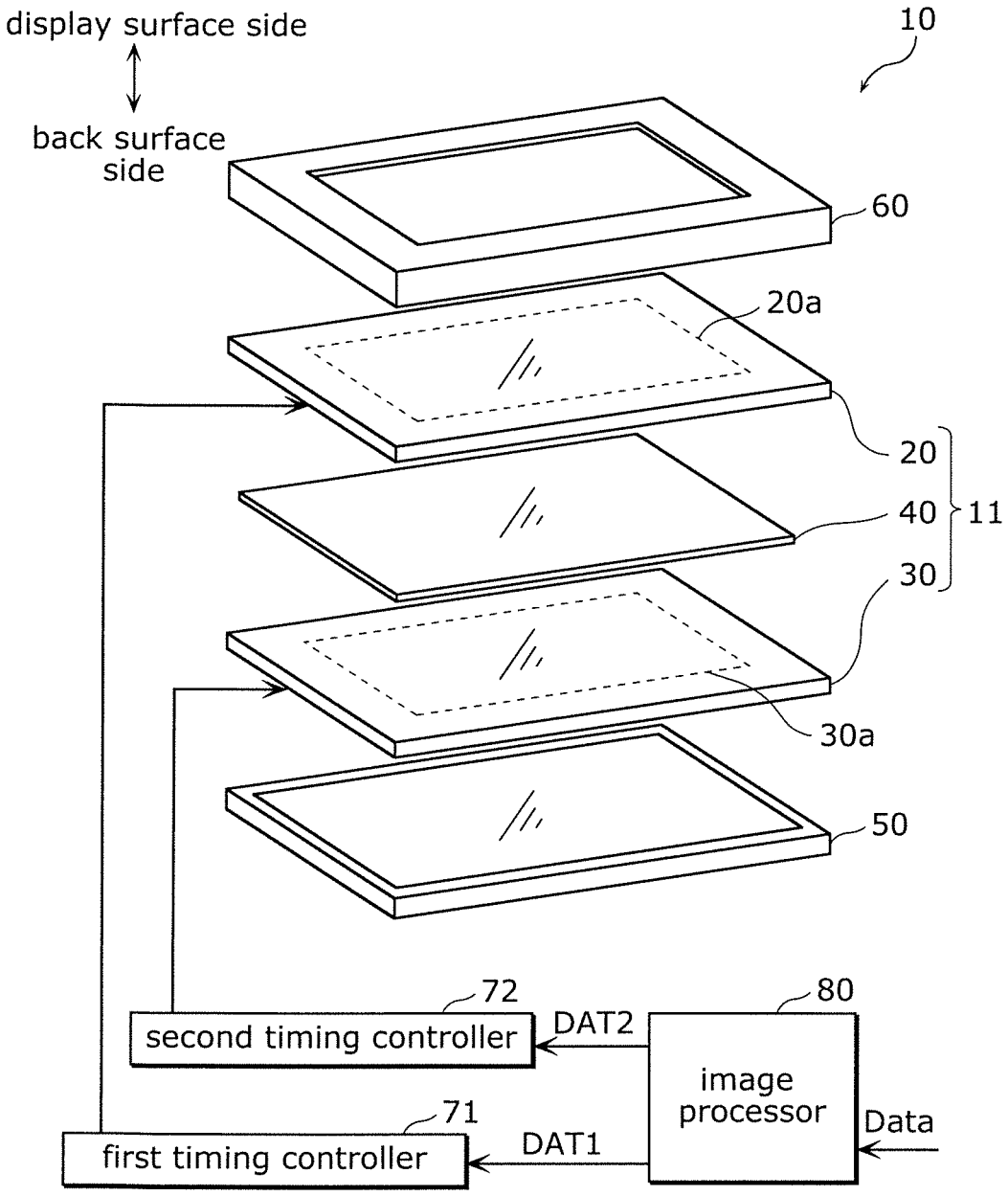
FIG. 1 is an exploded perspective view illustrating a liquid crystal display device according to a first exemplary embodiment.
Figure 2:
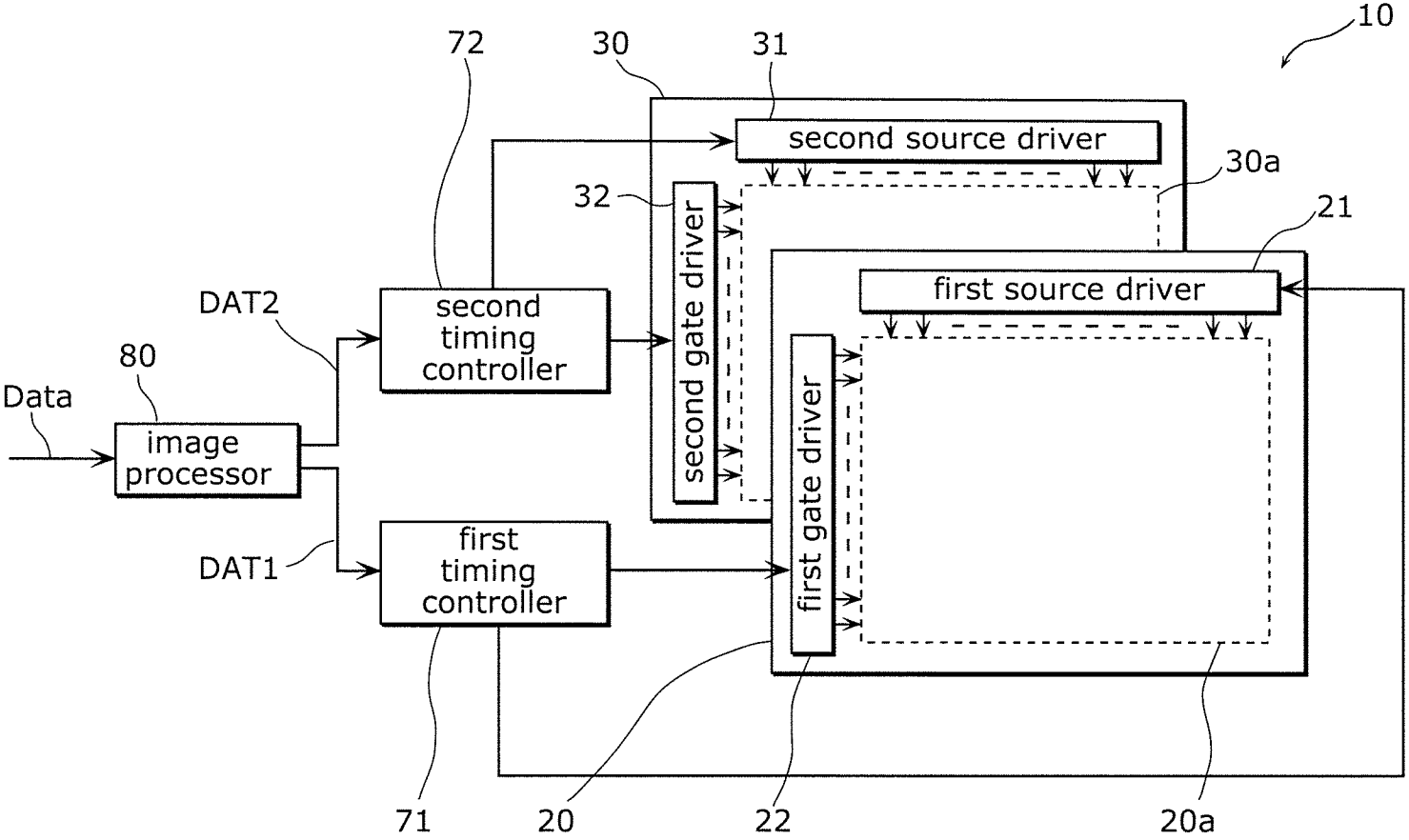
FIG. 2 is a view illustrating a schematic configuration of the liquid crystal display device of the first exemplary embodiment.
Figure 3:
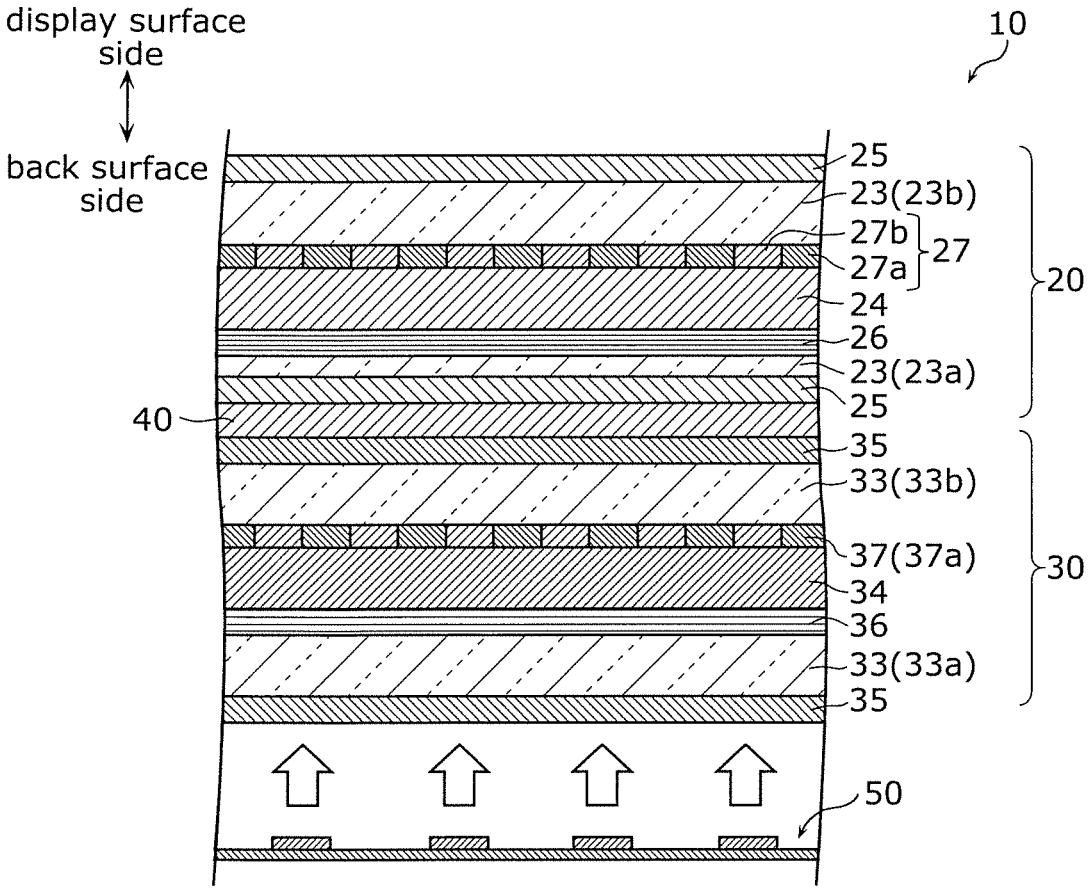
FIG. 3 is a partially enlarged sectional view illustrating the liquid crystal display device of the first exemplary embodiment.

A schematic configuration of whole liquid crystal display device 10 of the first exemplary embodiment will be described with reference to FIGS. 1 to 3. FIG. 1 is an exploded perspective view illustrating liquid crystal display device 10 of the first exemplary embodiment. FIG. 2 is a view illustrating a schematic configuration of liquid crystal display device 10 of the first exemplary embodiment. FIG. 2 illustrates a configuration of drivers of first liquid crystal panel 20 and second liquid crystal panel 30 in liquid crystal display device 10.

As illustrated in FIG. 1, liquid crystal display device 10 includes first liquid crystal panel 20 disposed at a position (front side) closer to the observer, second liquid crystal panel 30 disposed at a position (rear side) farther from the observer than first liquid crystal panel 20, adhesive layer 40 bonding first liquid crystal panel 20 and second liquid crystal panel 30, backlight 50 disposed on a back surface side (rear side) of second liquid crystal panel 30, and front chassis 60 covering first liquid crystal panel 20 and second liquid crystal panel 30 from an observer side.

First liquid crystal panel 20 and second liquid crystal panel 30 bonded together by adhesive layer 40 constitute liquid crystal display unit 11 (liquid crystal module), and are fixed to a middle frame (not illustrated) and a rear frame (not illustrated) together with backlight 50. Liquid crystal display unit 11 is an example of the display unit including first liquid crystal panel 20 and second liquid crystal panel 30 that is disposed while superposed on first liquid crystal panel 20 on the back surface side of first liquid crystal panel 20.

First liquid crystal panel 20 is a main panel that displays an image visually recognized by a user. In the first exemplary embodiment, first liquid crystal panel 20 displays a color image. On the other hand, second liquid crystal panel 30 is a sub-panel disposed on the back surface side of first liquid crystal panel 20. In the first exemplary embodiment, second liquid crystal panel 30 displays a monochrome image (black-and-white image) of an image pattern corresponding to the color image displayed on first liquid crystal panel 20 in synchronization with the color image.

For example, liquid crystal driving systems of first liquid crystal panel 20 and second liquid crystal panel 30 may be a lateral electric field system such as an IPS system or an FFS system. First liquid crystal panel 20 and second liquid crystal panel 30 are a normally black type in which white is displayed during a voltage applied state while black is displayed during a voltage non-applied state.

For example, the thickness of adhesive layer 40 is less than or equal to 0.5 mm. The thickness of adhesive layer 40 is set less than or equal to 0.5 mm, which allows the generation of the parallax to be prevented.

As illustrated in FIG. 2, first source driver 21 and first gate driver 22 are provided in first liquid crystal panel 20 in order to display the color image corresponding to the input image signal on first image display region 20*a*.

On the other hand, second source driver 31 and second gate driver 32 are provided in second liquid crystal panel 30 in order to display the monochrome image corresponding to the input image signal on second image display region 30*a*.

As illustrated in FIG. 1, backlight 50 is a surface light source that emits light toward first liquid crystal panel 20 and second liquid crystal panel 30. For example, backlight 50 is a light emitting diode (LED) backlight in which the LED is used as a light source. However, backlight 50 is not limited to the LED backlight. In the first exemplary embodiment, backlight 50 is a direct under type. Alternatively, backlight 50 may be an edge type. Backlight 50 may include an optical member such as a diffusion plate (diffusion sheet) that diffuses the light emitted from the light source.

Front chassis 60 is a front frame disposed on the observer side (front side). For example, front chassis 60 is a rectangular frame body. Preferably, front chassis 60 may be made of a metallic material, such as a steel sheet and an aluminum sheet, which has high rigidity, and may be made of a resin material.

As illustrated in FIG. 2, liquid crystal display device 10 includes first timing controller 71 that controls first source driver 21 and first gate driver 22 of first liquid crystal panel 20, second timing controller 72 that controls second source driver 31 and second gate driver 32 of second liquid crystal panel 30, and image processor 80 that outputs the image data to first timing controller 71 and second timing controller 72.

Image processor 80 receives input image signal Data transmitted from an external system (not illustrated), performs predetermined image processing on input video signal Data, outputs first output image signal DAT1 to first timing controller 71, and outputs second output image signal DAT2 to second timing controller 72. Image processor 80 also outputs a control signal (not illustrated) such as a synchronizing signal to first timing controller 71 and second timing controller 72. First output image signal DAT1 is image data used to display the color image, and second output image signal DAT2 is image data used to display the monochrome image.

In liquid crystal display device 10 of the first exemplary embodiment, the image is displayed while two display panels of, first liquid crystal panel 20 and second liquid crystal panel 30 are superimposed on each other, so that black can be tightened. Consequently, the image having a high contrast ratio can be displayed. For example, liquid crystal display device 10 is a high dynamic range (HDR) compatible television, and a local dimming compatible direct-under type LED backlight may be used as backlight 50. In this case, the color image having the higher contrast ratio and higher image quality can be displayed.

In the first exemplary embodiment, first liquid crystal panel 20 displays the color image in first image display region 20*a*, and second liquid crystal panel 30 displays the black-and-white image in second image display region 30*a*. However, the present disclosure is not limited thereto. Alternatively, for example, first liquid crystal panel 20 may display the black-and-white image in first image display region 20*a*, and second liquid crystal panel 30 may display the color image in second image display region 30*a*. For example, both first liquid crystal panel 20 and second liquid crystal panel 30 may display the color image or the black-and-white image.

The detailed configuration of liquid crystal display device 10 will be described with reference to FIG. 3. FIG. 3 is an enlarged sectional view illustrating liquid crystal display device 10 of the first exemplary embodiment.

First liquid crystal panel 20 will be described. As illustrated in FIG. 3, first liquid crystal panel 20 includes a pair of first transparent substrates 23, first liquid crystal layer 24, and a pair of first polarizing plates 25.

For example, first transparent substrates 23 are a glass substrate, and are disposed opposite to each other. In the first exemplary embodiment, first transparent substrate 23 located on the second liquid crystal panel 30 side in the pair of first transparent substrates 23 is first TFT substrate 23*a* that is a thin film transistor (TFT) substrate on which a TFT and the like are formed, and first transparent substrate 23 located on the side opposite to the second liquid crystal panel 30 side in the pair of first transparent substrates 23 is first counter substrate 23*b*.

First TFT layer 26 on which the TFT or a wiring is provided is formed on a surface of first TFT substrate 23*a* on the first liquid crystal layer 24 side. A pixel electrode used to apply voltage to first liquid crystal layer 24 is formed on a planarization layer of first TFT layer 26. In the first exemplary embodiment, because first liquid crystal panel 20 is driven by the IPS system, not only the pixel electrode but also the counter electrode are formed on first TFT substrate 23*a*. The TFT, the pixel electrode, and the counter electrode are formed in each pixel. An alignment film is formed so as to cover the pixel electrode and the counter electrode.

First counter substrate 23*b* is a color filter substrate (CF substrate) on which color filter 27*b* is formed, and first pixel formation layer 27 including first black matrix 27*a* and color filter 27*b* is formed on the surface of the first counter substrate 23*b* on the first liquid crystal layer 24 side.

First liquid crystal layer 24 is sealed between the pair of first transparent substrates 23. A liquid crystal material for first liquid crystal layer 24 can appropriately be selected according to the driving system. For example, the thickness of first liquid crystal layer 24 ranges from 2.5 μm to 6 μm, but is not limited thereto.

First pixel formation layer 27 is disposed between the pair of first transparent substrates 23. That is, first black matrix 27*a* and color filter 27*b* are disposed between the pair of first transparent substrates 23. A plurality of first openings having a matrix form and constituting pixels are formed in first black matrix 27*a*. That is, each of the plurality of first openings corresponds to each of the plurality of pixels. For example, first black matrix 27*a* is formed into a lattice shape such that each first opening has a rectangular shape in planar view.

Color filter 27*b* is formed in the first opening of first black matrix 27*a*. For example, color filter 27*b* is constructed with a red color filter, a green color filter, and a blue color filter. The color filter of each color corresponds to each pixel.

A pair of first polarizing plates 25 is a sheet-shaped polarizing film made of a resin material, and is disposed such that the pair of first transparent substrates 23 is sandwiched between the pair of first polarizing plates 25. The pair of first polarizing plates 25 is disposed such that polarization directions of first polarizing plates 25 are orthogonal to each other. That is, the pair of first polarizing plates 25 is disposed in a crossed Nicol state. For example, the thickness of each of the pair of first polarizing plates 25 ranges from 0.05 mm to 0.5 mm, but is not limited thereto.

Second liquid crystal panel 30 will be described below. The second liquid crystal panel 30 includes a pair of second transparent substrates 33, second liquid crystal layer 34, and a pair of second polarizing plates 35.

For example, second transparent substrates 33 are a glass substrate, and disposed opposite to each other. In the first exemplary embodiment, second transparent substrate 33 located on the side of backlight 50 in the pair of second transparent substrates 33 is second TFT substrate 33*a*, and second transparent substrate 33 located on the side of first liquid crystal panel 20 of the pair of second transparent substrates 33 is second counter substrate 33*b*. Second TFT substrate 33*a* has the same configuration as first TFT substrate 23*a* of first liquid crystal panel 20. Thus, second TFT layer 36 is formed on the surface of the second TFT substrate 33*a* on the second liquid crystal layer 34 side, and the pixel electrode and the counter electrode are formed in each pixel on the planarization layer of second TFT layer 36.

Second pixel formation layer 37 including second black matrix 37*a* is formed on the surface of second counter substrate 33*b* on the second liquid crystal layer 34 side.

Second liquid crystal layer 34 is sealed between the pair of second transparent substrates 33. For example, the thickness of the second liquid crystal layer 34 ranges from 2.5 μm to 6 μm, but is not limited thereto.

Second pixel formation layer 37 is disposed between the pair of second transparent substrates 33. That is, second black matrix 37*a* is disposed between the pair of second transparent substrates 33. A plurality of second openings having a matrix form and constituting the pixels are formed in second black matrix 37*a*. That is, each of the plurality of second openings corresponds to each of the plurality of pixels. For example, second black matrix 37*a* is formed into a lattice shape such that each second opening has a rectangular shape in planar view.

A pair of second polarizing plates 35 is a sheet-shaped polarizing film made of a resin material, and is disposed such that the pair of second transparent substrates 33 is sandwiched between the pair of second polarizing plates 35. That is, the pair of second polarizing plates 35 is disposed in the crossed Nicol state. For example, the thickness of each of the pair of second polarizing plates 35 ranges from 0.05 mm to 0.5 mm, but is not limited thereto.

Figure 4:
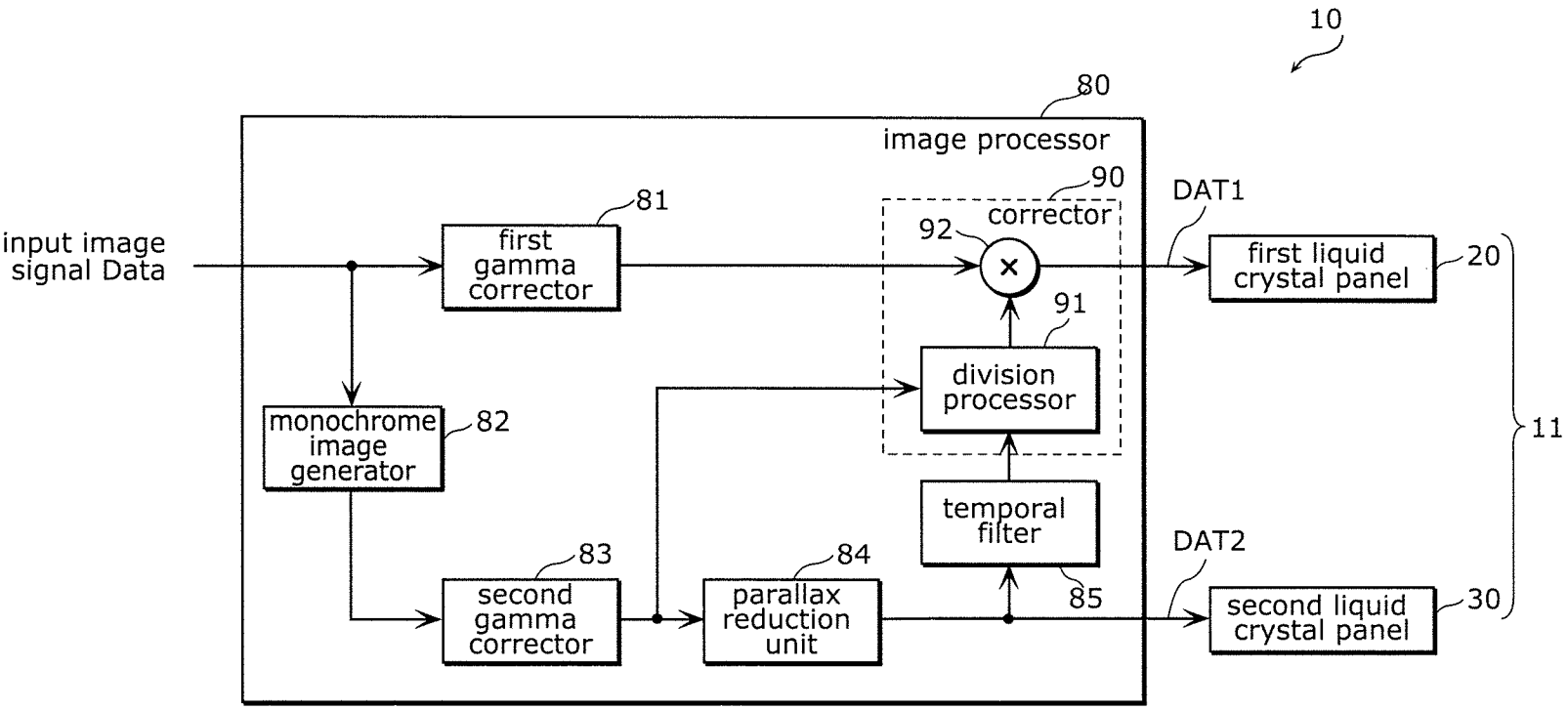
FIG. 4 is a block diagram illustrating a functional configuration of an image processor of the first exemplary embodiment.

The configuration of image processor 80 will be described below with reference to FIG. 4. FIG. 4 is a block diagram illustrating a functional configuration of image processor 80 of the first exemplary embodiment.

As illustrated in FIG. 4, image processor 80 generates first output image signal DAT1 output to first liquid crystal panel 20 and second output image signal DAT2 output to second liquid crystal panel 30 based on input image signal Data. For example, first output image signal DAT1 is input to first liquid crystal panel 20 without performing additional signal processing on first output image signal DAT1. For example, second output image signal DAT2 is input to second liquid crystal panel 30 without performing additional signal processing on second output image signal DAT2.

Image processor 80 includes first gamma corrector 81, black-and-white image generator 82, second gamma corrector 83, parallax reduction unit 84, temporal filter 85, and corrector 90. In FIG. 4 and the subsequent drawings, first timing controller 71, second timing controller 72, and the like are not illustrated for convenience.

First gamma corrector 81 and second gamma corrector 83 perform predetermined gradation conversion on an input signal. First gamma corrector 81 performs the gradation conversion in order to generate first output image signal DAT1. First gamma corrector 81 performs the gradation conversion of input image signal Data such that a combined luminance characteristic of first liquid crystal panel 20 and second liquid crystal panel 30 becomes desired gamma. Second gamma corrector 83 performs the gradation conversion in order to generate second output image signal DAT2. Second gamma corrector 83 performs the gradation conversion of black-and-white image data output from black-and-white image generator 82 such that the combined luminance characteristic of first liquid crystal panel 20 and second liquid crystal panel 30 becomes desired gamma.

Assuming that D is input gradation (gradation value normalized by 1) of input image signal Data, that rm is a gamma value of first liquid crystal panel 20, that rs is a gamma value of second liquid crystal panel 30, that r1 is a gamma value of first gamma corrector 81, and that r2 is a gamma value of second gamma corrector 83, combined luminance L is given by the following equation 1.

$$L=(D^{r1})^{rm}\times(D^{r2})^{rs}=D^{r1\times rm+r2\times rs} \quad \text{(equation 1)}$$

For example, when the gamma value rm of first liquid crystal panel 20 and the gamma value rs of second liquid crystal panel 30 are each 2.2, first gamma corrector 81 and second gamma corrector 83 perform the gradation conversion such that the gamma value of combined luminance L becomes 2.2, namely, the following equation 2 is satisfied.

$$r1+r2=1 \quad \text{(equation 2)}$$

For example, first gamma corrector 81 and second gamma corrector 83 include a conversion table (look-up table) based on a gradation conversion characteristic, and may determine the gradation values corresponding to the color image data and black-and-white image data using the conversion table. For example, the conversion table is stored in a storage (not illustrated) of image processor 80.

It is possible to provide one of first gamma corrector 81 and second gamma corrector 83. The black-and-white image data is an example of the first signal based on input image signal Data, and second gamma corrector 83 is an example of the gradation corrector.

Black-and-white image generator 82 generates the black-and-white image data corresponding to the black-and-white image (monochrome image) displayed on second liquid crystal panel 30 based on input image signal Data (color image signal). When acquiring an input image signal Data, black-and-white image generator 82 generates the black-and-white image data corresponding to the black-and-white image using a maximum value (an R value, a G value, or a B value) in each color value (for example, an RGB value: [R value, G value, B value]) indicating color information about input image signal Data. Specifically, in the RGB value corresponding to each pixel, black-and-white image generator 82 generates the black-and-white image data by setting the maximum value in the RGB values to the value of the pixel.

Parallax reduction unit 84 receives gradation-corrected input image signal Data (for example, gradation-corrected black-and-white image data) output from second gamma corrector 83, performs smoothing processing on gradation-corrected input image signal Data, and generates second output image signal DAT2. For example, parallax reduction unit 84 performs correction reducing the parallax between the first image based on first output image signal DAT1 and the second image based on second output image signal DAT2. When acquiring the gradation-converted black-and-white image data, parallax reduction unit 84 performs expansion filtering processing of expanding a high-luminance region on the black-and-white image data. For example, concerning each pixel (target pixel) of second liquid crystal panel 30, the expansion filtering processing is processing of setting a maximum value of luminance within a predetermined filter size (for example, several pixels× several pixels) to the luminance of the pixel (target pixel). The expansion filtering processing is performed on each of the plurality of pixels. The high-luminance region (for example, a white region) extends as a whole through the expansion filtering processing. Consequently, the degradation of the image quality due to the generation of the parallax such as a double image in which an outline of the image appears double can be prevented when liquid crystal display device 10 is viewed from an oblique direction. The filter size is not particularly limited. The filter shape is not limited to the square shape, but may be a circular shape.

For example, parallax reduction unit 84 is constructed with a low-pass filter such as what is called a MAX filter (maximum value filter) and a Gaussian filter. That is, parallax reduction unit 84 performs low-pass filtering processing. Preferably, the low-pass filter may change the filter size. Parallax reduction unit 84 can perform the parallax reduction according to an interval between first liquid crystal panel 20 and second liquid crystal panel 30 by determining the appropriate filter size according to the interval.

Parallax reduction unit 84 is an example of the first parallax reduction unit. In the first exemplary embodiment, second output image signal DAT2 is an example of the first parallax reduction signal, and the low-pass filter is an example of the smoothing filter.

Temporal filter 85 generates a correction signal matching a response speed of first liquid crystal panel 20 with a response speed of second liquid crystal panel 30. For example, the correction signal is a signal bringing a response difference between first liquid crystal panel 20 and second liquid crystal panel 30 close to zero. For example, it can be said that the correction signal is a signal adjusting a display reflesh speed of first liquid crystal panel 20 according to the response speed of second liquid crystal panel 30. When the response speed of first liquid crystal panel 20 is faster, it can be said that the correction signal is a signal delaying the response of the display image of first liquid crystal panel 20 (specifically, delaying the response in a low-frequency region of the display image of first liquid crystal panel 20). Temporal filter 85 is an example of the first temporal filter, and the correction signal is an example of the first response correction signal.

Temporal filter 85 receives second output image signal DAT2, and generates the correction signal determining first output image signal DAT1 based on second output image signal DAT2. Specifically, temporal filter 85 generates the correction signal by performing the filtering processing in a temporal (time-axis) direction using second output image signal DAT2 and the correction signal (an example of the output signal) output from temporal filter 85 to corrector 90 in the past frame. The filtering processing will be described later.

For example, when the response speed of first liquid crystal panel 20 is faster than that of second liquid crystal panel 30, temporal filter 85 generates the correction signal such that the display reflesh speed of first liquid crystal panel 20 becomes slower. For example, when the response speed of first liquid crystal panel 20 is slower than that of second liquid crystal panel 30, temporal filter 85 generates the correction signal such that the display reflesh speed of first liquid crystal panel 20 becomes faster.

Temporal filter 85 performs the above processing on second output image signal DAT2 output from parallax reduction unit 84. Second output image signal DAT2 is a signal mainly including a low-frequency component because parallax reduction unit 84 already performs the low-pass filtering processing on second output image signal DAT2. That is, temporal filter 85 generates the correction signal correcting first output image signal DAT1 of first liquid crystal panel 20 such that the response speed or delay of the low-frequency component of second liquid crystal panel 30 is reflected in the response speed or delay of the low-frequency component of first liquid crystal panel 20. Temporal filter 85 operates so as to set the response difference in low-frequency components between first liquid crystal panel 20 and second liquid crystal panel 30 to zero. In other words, temporal filter 85 does not affect the high-frequency components of first liquid crystal panel 20.

Consequently, in the display image displayed by image processor 80, the response difference of the low-frequency component is principally zero, so that the response difference between first liquid crystal panel 20 and second liquid crystal panel 30 can be brought close to zero in the region of the low-frequency component (hereinafter, also referred to as a low-frequency region). In the display image displayed by image processor 80, the high-frequency component is directly displayed on first liquid crystal panel 20, so that generation of moving image blur can be prevented in a moving image. Image processor 80 is able to not delay or quicken the display of whole first liquid crystal panel 20, but delay or quicken the display of the low-frequency component having a little influence on the degradation of moving image quality.

Temporal filter 85 does not perform any processing on second output image signal DAT2 output to second liquid crystal panel 30. That is, second output image signal DAT2 output from parallax reduction unit 84 is directly input to second liquid crystal panel 30.

The filtering processing of temporal filter 85 will be described. Assuming that VI1*n*(i, j) is sub data at pixel position(i, j) of an n-th frame, that VO1*n*−1(*i, j*) is output data of temporal filter 85 at pixel position (i, j) of an (n−1)-th frame, and that K1 is a time constant, output data VO1*n*(i, j) of temporal filter 85 at pixel position (i, j) of an n-th frame is given by the following equation 3.

$$VO1n(i,j)=\{VI1n(i,j)-VO1n-1(i,j)\}\times K1+VO1n-1(i,j) \quad \text{(equation 3)}$$

As illustrated in the equation 3, temporal filter 85 calculates the output data of the current frame (an example of the correction signal of the current frame) using the input data of the current frame (second output image signal DAT2 of the current frame) and the output data of the past frame (an example of the correction signal of the past frame). In other words, temporal filter 85 performs such processing that the past-frame output data affects the current-frame output data. In the first exemplary embodiment, temporal filter 85 is configured such that the output data of the immediately preceding frame affects the next-frame output data.

For example, time constant K1 is set according to the difference in response speed between first liquid crystal panel 20 and second liquid crystal panel 30. For example, when the response speed of first liquid crystal panel 20 is faster than that of second liquid crystal panel 30, time constant K1 is set to a value smaller than 1. Consequently, temporal filter 85 can output second output image signal DAT2 to corrector 90 while delaying second output image signal DAT2, so that the response of first liquid crystal panel 20 can be delayed. That is, the difference in response speed between first liquid crystal panel 20 and second liquid crystal panel 30 can be shortened. The difference in response speed means a difference in response, and a difference between the switching speed (for example, a speed of luminance change) of first liquid crystal panel 20 and the switching speed (for example, a speed of luminance change) of second liquid crystal panel 30.

Time constant K1 is set to a value larger than 1 when the response speed of second liquid crystal panel 30 is faster than that of first liquid crystal panel 20. Consequently, temporal filter 85 can output second output image signal DAT2 to corrector 90 while overdriving second output image signal DAT2, so that the response of first liquid crystal panel 20 can be quickened. That is, the difference in response speed between first liquid crystal panel 20 and second liquid crystal panel 30 can be shortened.

In this way, temporal filter 85 adjusts the value of time constant K1 to bring the difference in response between first liquid crystal panel 20 and second liquid crystal panel 30 close to zero.

For example, the response speeds of first liquid crystal panel 20 and second liquid crystal panel 30 are measured, and time constant K1 may previously be set based on a measurement result. For example, time constant K1 may be set to a predetermined value. Time constant K1 is an example of the filter coefficient.

For example, a low-pass filter having an infinite impulse response (IIR) filter configuration can be applied to temporal filter 85. For example, temporal filter 85 may be a low-pass filter having an IIR filter configuration of a first-order lag system. In the above description, temporal filter 85 is the first-order IIR filter that refers to the output data of one frame before in order to calculate the output data of the current frame. Alternatively, a multi-order IIR filter that refers to the output data of a plurality of past frames may be used as temporal filter 85. For example, temporal filter 85 may be an IIR filter that refers to the output data of one frame before and the output data of two frames before to calculate the output data of the current frame, or an IIR filter that refers to the output data of one frame to three frames before.

Temporal filter 85 is not limited to the low-pass filter having the IIR filter configuration. For example, temporal filter 85 may be a low-pass filter having a finite impulse response (FIR) filter configuration. For example, temporal filter 85 may be a median filter.

Image processor 80 includes a frame memory (not illustrated) that stores the output data of temporal filter 85 in the past frame. For example, temporal filter 85 may include the frame memory.

Temporal filter 85 is not limited to the use of the approximate equation such as the equation 3. For example, temporal filter 85 may generate the correction signal by calculating an output value using a look-up table (LUT) in FIG. 5. FIG. 5 is a view illustrating an example of the look-up table included in temporal filter 85 of the first exemplary embodiment. The look-up table is a table in which the output value of the correction signal of one frame before, the input value of second output image signal DAT2 of the current frame, and the output value of the correction signal of the current frame are associated with each other. For example, the look-up table is stored in the storage (not illustrated) of image processor 80. The look-up table is an example of the conversion table.

With reference to FIG. 4 again, corrector 90 corrects the second signal based on input image signal Data using the current-frame correction signal output from temporal filter 85, thereby generating first output image signal DAT1. In the first exemplary embodiment, corrector 90 corrects input image signal Data subjected to the gradation correction performed by first gamma corrector 81 using the current-frame correction signal, thereby generating first output image signal DAT1. Input image signal Data subjected to the gradation correction performed by first gamma corrector 81 is an example of the second signal based on input image signal Data.

Corrector 90 corrects the gradation value of each pixel of the signal from first gamma corrector 81 such that a combined image of the first image displayed on first liquid crystal panel 20 based on first output image signal DAT1 and the second image displayed on second liquid crystal panel 30 based on second output image signal DAT2 becomes the image based on input image signal Data, thereby generating first output image signal DAT1. Corrector 90 receives at least the correction signal and input image signal Data subjected to the gradation correction performed by first gamma corrector 81, and generates first output image signal DAT1 output based on at least the correction signal and input image signal Data subjected to the gradation correction. In the first exemplary embodiment, corrector 90 corrects the color image data output from first gamma corrector 81 based on the black-and-white image data that is output from second gamma corrector 83 and subjected to the gradation correction and the correction signal output from temporal filter 85. In this way, corrector 90 performs processing of feeding back a change in the signal changed by parallax reduction unit 84 and temporal filter 85 to the signal on the side of first liquid crystal panel 20. Combined luminance L is maintained at $L=D^{2.2}$ according to the equation 1 by maintaining first output image signal DAT1×second output image signal DAT2=input image signal Data. Hereinafter, the signal output from first gamma corrector 81 and input to corrector 90 is also referred to as the first signal.

Corrector 90 includes a division processor 91 and a multiplier 92.

Division processor 91 calculates the correction value used to correct the gradation value for each pixel of the signal output from first gamma corrector 81 based on the black-and-white image data subjected to the gradation correction and the correction signal. For example, division processor 91 calculates the correction value by dividing the current-frame black and white image data subjected to the gradation correction by the current-frame correction signal. Alternatively, division processor 91 may acquire the correction value by referring to the look-up table.

Multiplier 92 corrects the gradation value of the signal from first gamma corrector 81 based on the acquired correction value. Specifically, multiplier 92 sets the gradation value acquired by multiplying the signal from first gamma corrector 81 by the correction value to the gradation value of first output image signal DAT1. Consequently, first output image signal DAT1 becomes the signal of the gradation value reflecting the processing of parallax reduction unit 84 and temporal filter 85. That is, first output image signal DAT1 becomes the signal reflecting the delay of second output image signal DAT2 due to the processing of temporal filter 85.

For example, each component included in image processor 80 is formed of a dedicated circuit. Alternatively, each component may be formed of a processor or the like.

Figure 6:
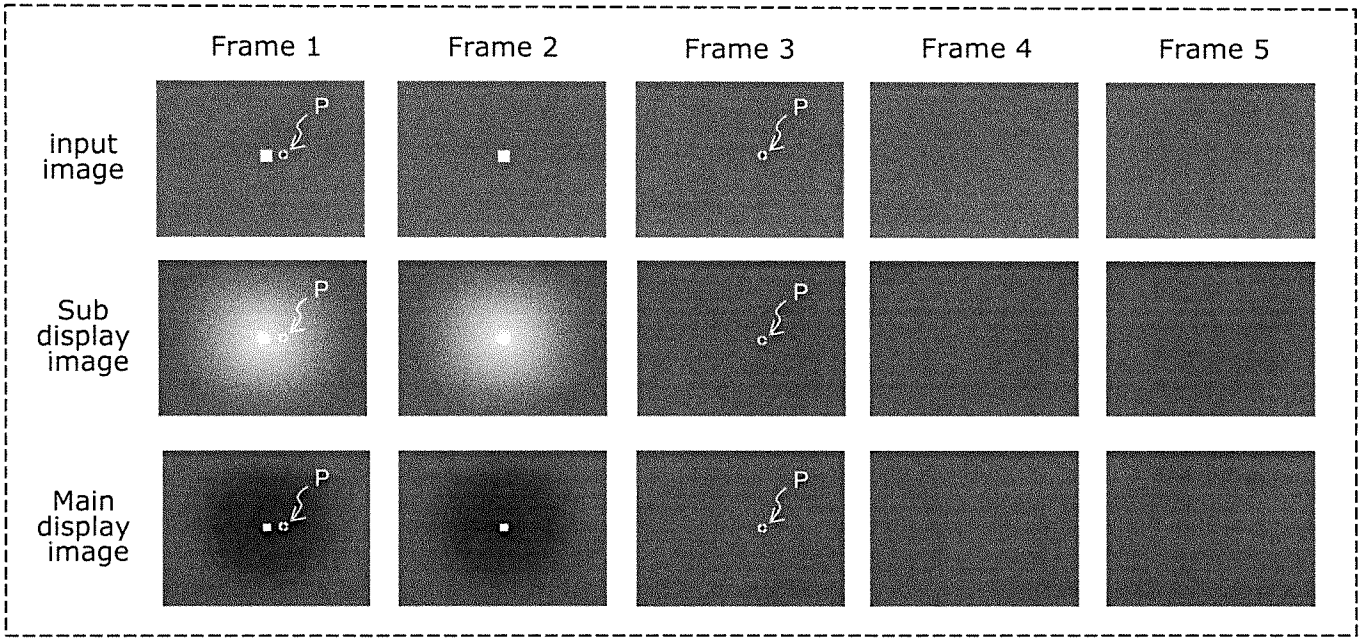
FIG. 6 is a view illustrating an example of an input image of the first exemplary embodiment, and a sub display image and a main image at that time.

A difference between the case where image processor 80 includes temporal filter 85 and the case where image processor 80 does not include temporal filter 85 will be described. FIG. 6 is a view illustrating an example of an input image of the first exemplary embodiment, and a sub display image and a main image at that time. FIG. 6 schematically illustrates the input image, the sub display image, and the main display image in five frames from a first frame to a fifth frame (Frame1 to Frame5 in FIG. 6). For example, a size of a white window of the input image is 32 pixels×32 pixels. The sub display image is an example of the second image, and the main image is an example of the first image.

Figure 7:
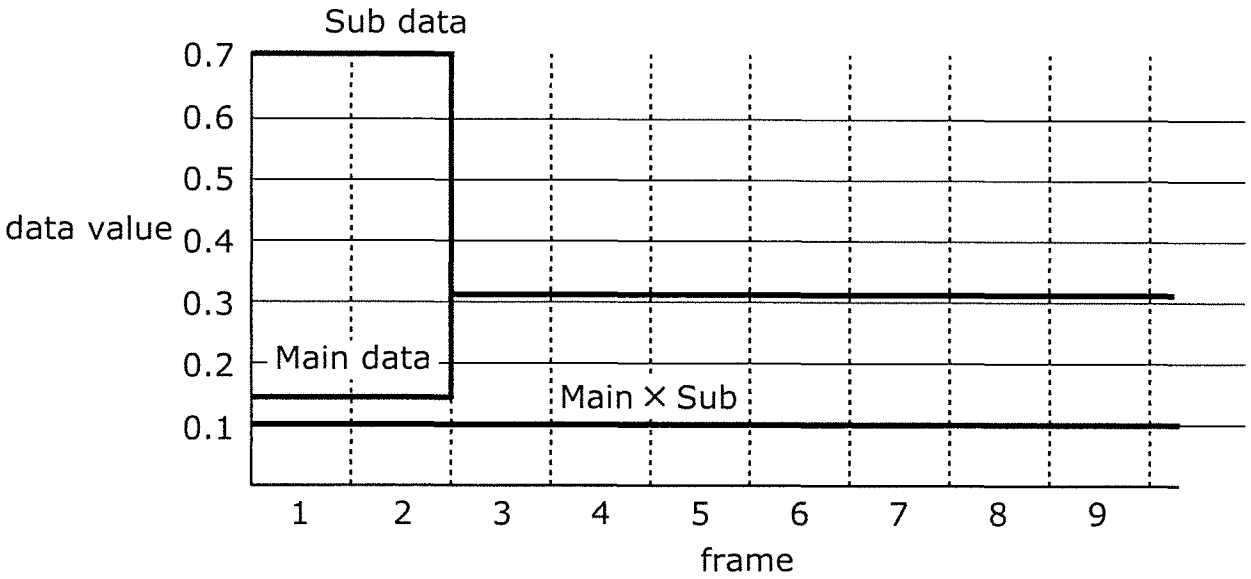
FIG. 7 is a view illustrating an example of various data at a point P in FIG. 6.

FIG. 7 is a view illustrating an example of various data at a point P in FIG. 6. In FIG. 7, for convenience, point P is illustrated only in the first frame and the third frame. A horizontal axis in FIG. 7 indicates a frame, and a vertical axis indicates a data value input to the liquid crystal panel. The data value is the gradation value (gradation value normalized by 1) of the output image signal. Further, main data indicates first output image signal DAT1 output to first liquid crystal panel 20, and sub data indicates second output image signal DAT2 output to second liquid crystal panel 30. When the data value is raised to the power of 2.2, a luminance value (normalized luminance value) is obtained.

FIGS. 6 and 7 illustrate the case where the image in which a white window is displayed in the first and second framed and the white window is not displayed in the third to fifth frames is displayed. That is, FIGS. 6 and 7 illustrate the case of the display in which the white window disappears between the second and third frames. The image in FIG. 6 is for explanation only and illustrates an ideal display image. That is, FIG. 6 illustrates the case where the response speeds of first liquid crystal panel 20 and second liquid crystal panel 30 are equal to each other (zero).

Assuming that the input pixel has the gradation value of 0.1 at point P, that first gamma corrector 81 has gamma value r1 of 0.5, and that second gamma corrector 83 has gamma value r2 of 0.5, the output value (gradation value) of second gamma corrector 83 is given by the following equation 4.

$$0.1^{05} \approx 0.316 \quad \text{(equation 4)}$$

It is assumed that the gradation value at point P in second output image signal DAT2 becomes 0.7 through the filtering processing of parallax reduction unit 84. At this point, when image processor 80 does not include temporal filter 85, the gradation value at point P in first output image signal DAT1 becomes about 0.143.

Figure 8:
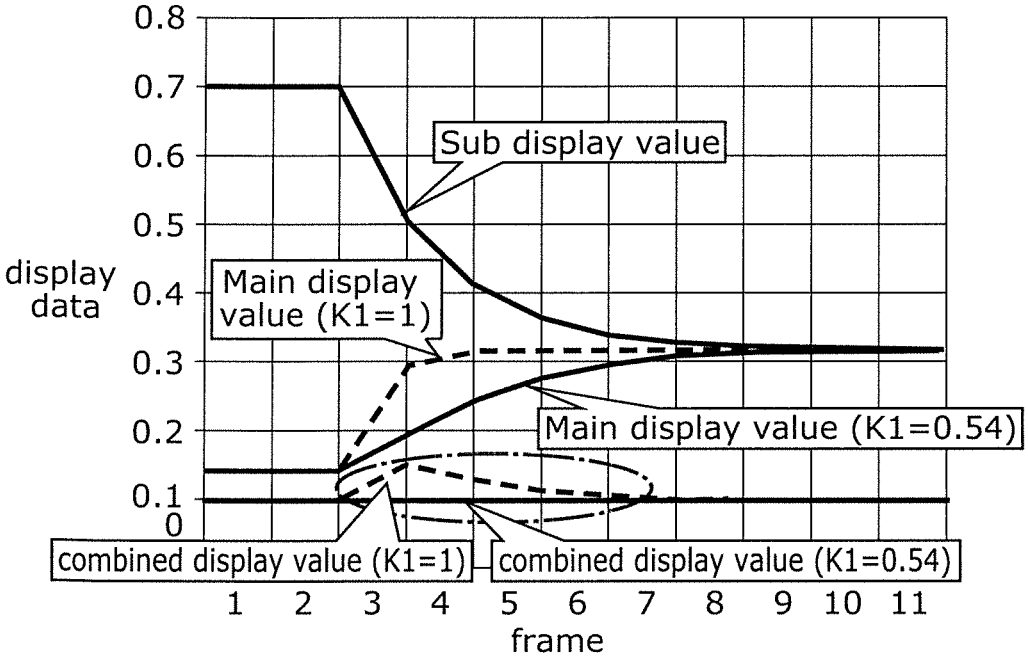
FIG. 8 is a view illustrating an example of display data at point P in FIG. 6.

When the response speeds of first liquid crystal panel 20 and second liquid crystal panel 30 are neglected, combined luminance L at point P is kept constant as in the input image. However, in practice, each of first liquid crystal panel 20 and second liquid crystal panel 30 has a response time, and the luminance transitions accord with the response time. FIG. 8 illustrates actual luminance transitions of first liquid crystal panel 20 and second liquid crystal panel 30.

FIG. 8 is a view illustrating an example of the display data at point P in FIG. 6. The horizontal axis in FIG. 8 indicates the frame, and the vertical axis indicates the display data. The display data indicates the luminance value (luminance value normalized by 1). A broken line indicates the luminance transition when time constant K1 of temporal filter 85 is set to 1. That is, the broken line indicates the luminance transition of the liquid crystal display device that does not include temporal filter 85. A solid line indicates the luminance transition when time constant K1 of temporal filter 85 is set to 0.54. That is, the solid line indicates the luminance transition when temporal filter 85 slows down the luminance change of first liquid crystal panel 20 by an amount corresponding to the response difference between first liquid crystal panel 20 and second liquid crystal panel 30 (slows down the response speed of first liquid crystal panel 20).

FIG. 8 illustrates the display data when a time constant K21 of first liquid crystal panel 20 is set to 0.85 while a time constant K22 of second liquid crystal panel 30 is set to 0.5. Assuming that Dn is the display data of an n-th frame and that Dn−1 is the display data of (n−1)-th frame, a luminance value Ln at point P is given by the following equation 5 in consideration of the response of the liquid crystal.

$$Ln=\{(Dn-Dn-1)\times K3+Dn-1\}^{2.2} \quad \text{(equation 5)}$$

The data value (gradation value) D for luminance value Ln can be converted by the following equation 6.

$$D(Ln)=(Dn-Dn-1)\times K3+Dn-1 \quad \text{(equation 6)}$$

Where Dn is the data value of the n-th frame, Dn−1 is the data value of the (n−1)-th frame, and K3 is a time constant of the liquid crystal panel.

As illustrated in FIG. 8, for time constant K1=1, namely, when temporal filter 85 is not included, the display data of first liquid crystal panel 20 changes without any consideration of the response speed of second liquid crystal panel 30. In this case, the combined display value (K1=1) indicated by the broken line indicates the luminance value (the combined luminance of first liquid crystal panel 20 and second liquid crystal panel 30) of the image displayed as the liquid crystal display device.

For time constant K1=1, the response speed of second liquid crystal panel 30 is faster than that of first liquid crystal panel 20, so that when the transition from the second frame to the third frame occurs, the luminance of first liquid crystal panel 20 increases faster than a decrease in luminance of second liquid crystal panel 30. As a result, as illustrated in the frame indicated by an alternate long and short dash line, the combined display value (K1=1) becomes larger than the original value of 0.1 between the third frame and several frames. That is, when temporal filter 85 is not included, at point P, the display brighter than the original display is performed between the third frame and several frames.

Figure 9:
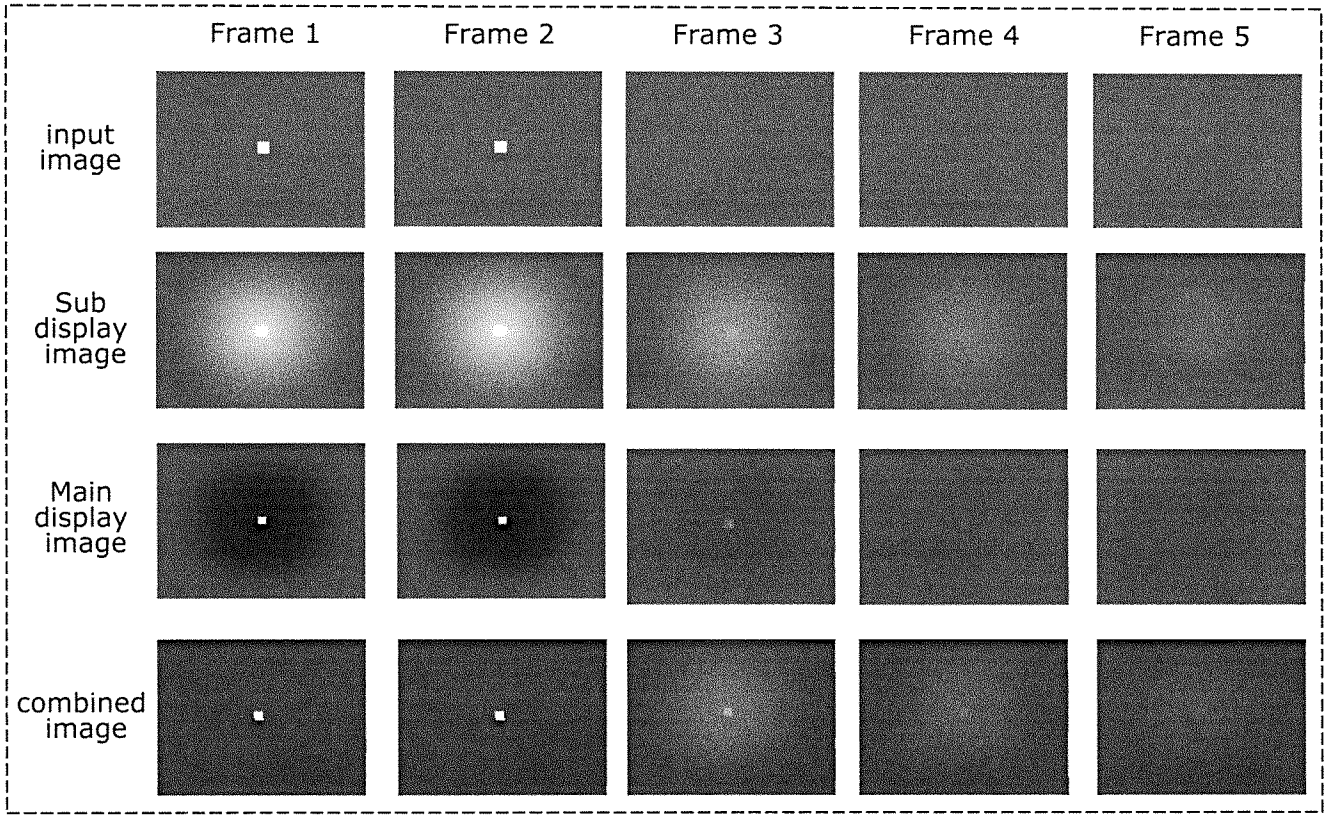
FIG. 9 is a view illustrating an example of a display image of a liquid crystal display device according to a first comparative example.

FIG. 9 is a view illustrating an example of the display image of a liquid crystal display device according to a first comparative example. FIG. 9 schematically illustrates the input image, the sub display image displayed on second liquid crystal panel 30, the main image displayed on first liquid crystal panel 20, and the combined image displayed on the liquid crystal display device. The combined image is an image obtained by combining the sub display image and the main image. The liquid crystal display device of the first comparative example means a liquid crystal display device in which the time constant of temporal filter 85 is K1=1.

As illustrated in FIG. 9, the luminance surrounding the white window after the third frame decreases slowly in the sub display image, but the luminance surrounding the white window after the third frame increases rapidly in the main display image. As a result, as in the combined image, a flicker that is a phenomenon in which a periphery of the white window shines brightly is generated in the frames from the third frame.

On the other hand, liquid crystal display device 10 of the first exemplary embodiment adjusts the response speed of first liquid crystal panel 20 according to the response speed of second liquid crystal panel 30 as illustrated in FIG. 8. In the first exemplary embodiment, because the response speed of first liquid crystal panel 20 is faster than that of second liquid crystal panel 30, temporal filter 85 performs the filtering processing so as to delay the response of first liquid crystal panel 20. Consequently, temporal filter 85 can delay the display of first liquid crystal panel 20 from the broken line of the main display value (K1=1) as illustrated by the solid line of the main display value (K1=0.54) in FIG. 8. That is, temporal filter 85 can lengthen the time until the luminance value of first liquid crystal panel 20 reaches around 0.316.

It can also be said that temporal filter 85 increases the luminance of first liquid crystal panel 20 at a speed corresponding to the speed at which the luminance of second liquid crystal panel 30 decreases. As a result, as illustrated by the frame indicated by the alternate long and short dash line, the combined display value (K1=0.54) can obtain the original value of 0.1 even between the third frame and several frames. That is, when temporal filter 85 is included, at point P, the originally displayed brightness display is performed even between the third frame and several frames.

Figure 10:
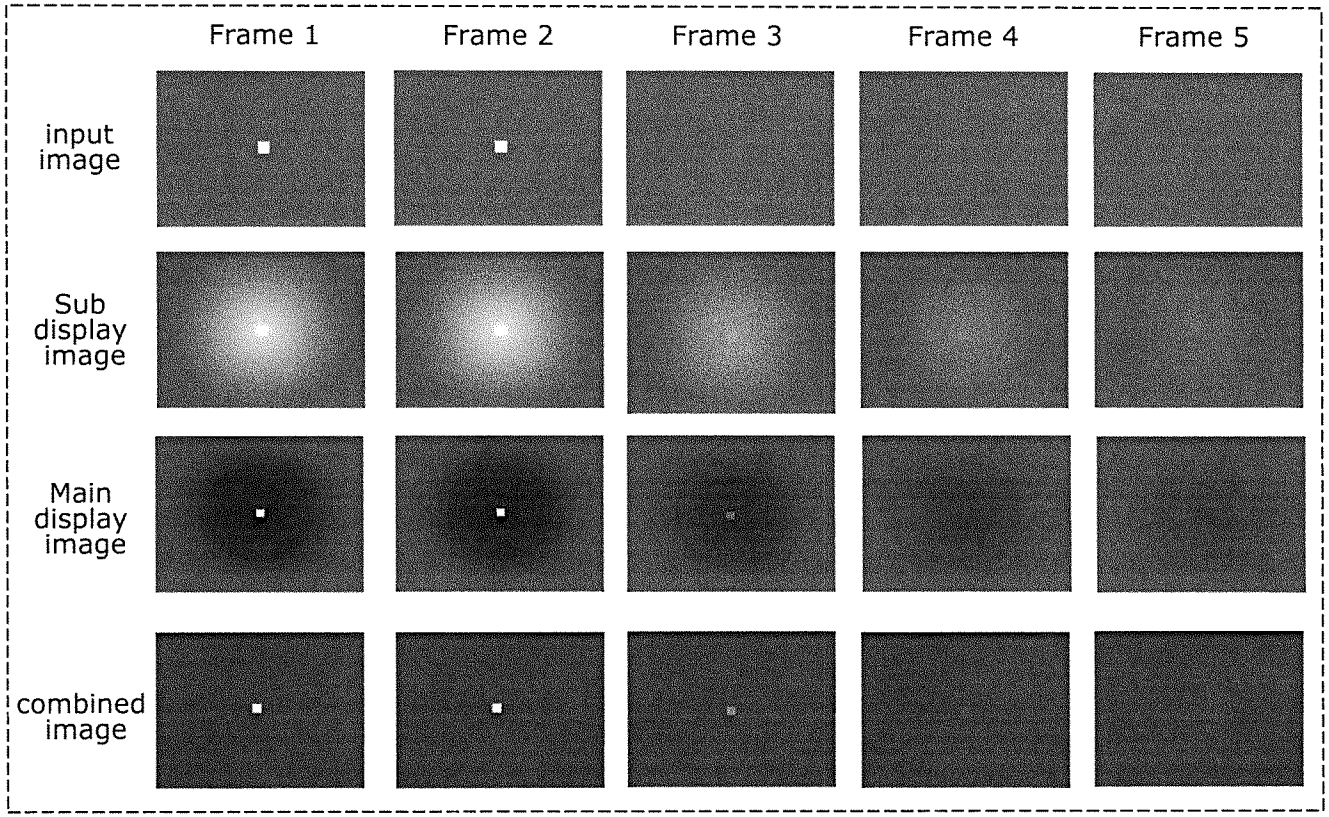
FIG. 10 is a view illustrating an example of the display image of the liquid crystal display device of the first exemplary embodiment.

As a result, as illustrated in FIG. 10, the decrease in luminance surrounding the white window after the frames from the third frame in the sub display image and the increase in luminance surrounding the white window after the frames from the third frame in the main display image are performed at a corresponding speed. In the first exemplary embodiment, the increase in luminance surrounding the white window after the frames from the third frame in first liquid crystal panel 20 is performed at a slower speed than the original speed. As a result, as illustrated in the combined image, the generation of the flicker that is the phenomenon in which the periphery of the white window shines brightly can be prevented. FIG. 10 is a view illustrating an example of the display image of liquid crystal display device 10 of the first exemplary embodiment.

As illustrated in the composite images of FIGS. 9 and 10, the display itself of the white window itself does not change between the first frame and the fifth frame, and only the luminance surrounding the white window changes. As described above, temporal filter 85 performs the filtering processing on the signal subjected to the low-pass filtering processing performed by parallax reduction unit 84. That is, temporal filter 85 acquires a low-frequency signal component from parallax reduction unit 84, and performs the filtering processing on the low-frequency signal component. Consequently, corrector 90 can reflect the delay of the low-frequency component of second liquid crystal panel 30 in the signal to first liquid crystal panel 20. That is, the speeds (for example, the slowness) of the low-frequency components in first liquid crystal panel 20 and second liquid crystal panel 30 can be matched with each other. Because the high-frequency component in first liquid crystal panel 20 does not change (no delay), the influence on the movement of the white window is small.

Figure 11:
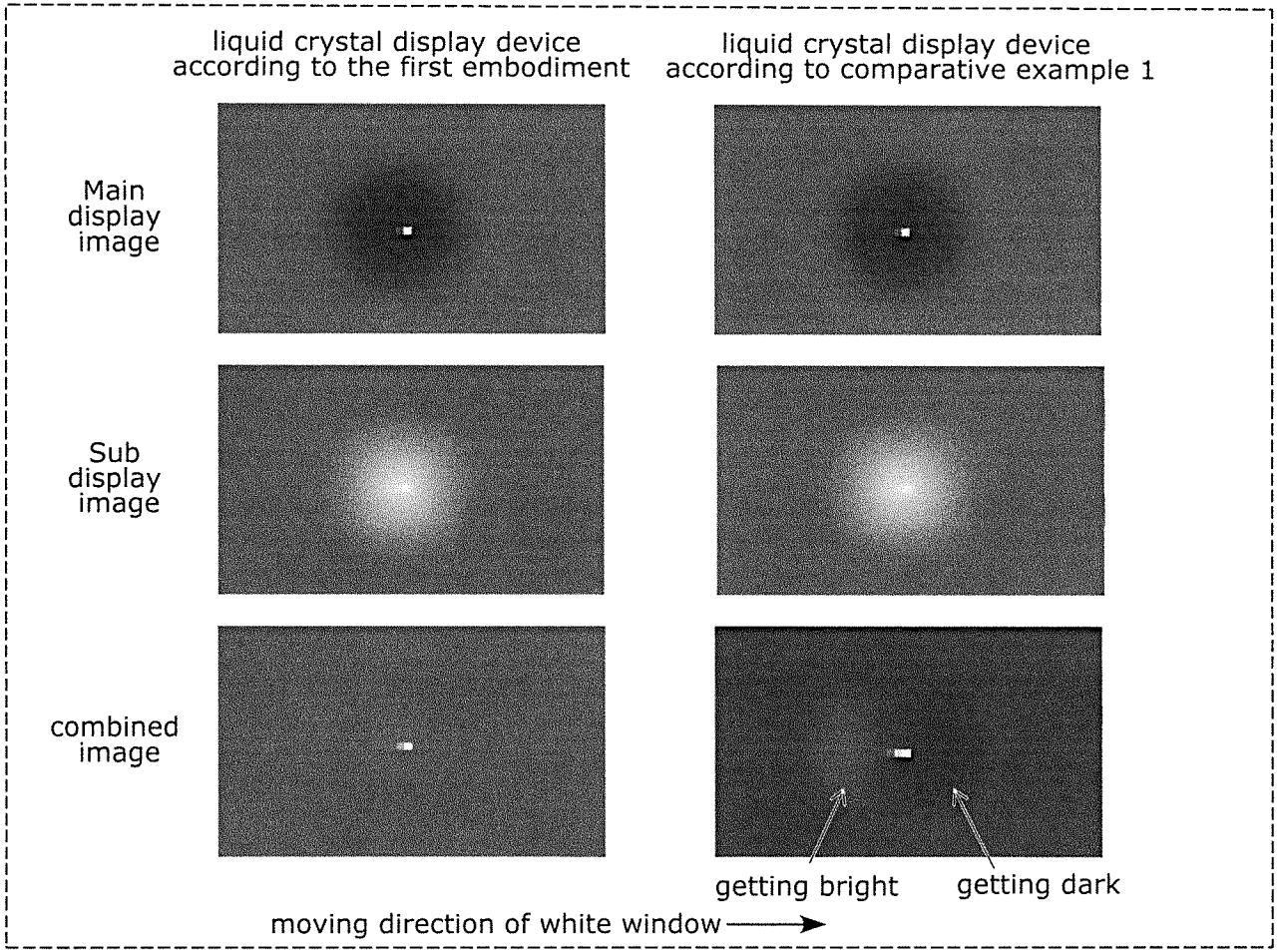
FIG. 11 is a first view illustrating an action when a scroll image is displayed on the liquid crystal display device of the first exemplary embodiment.
Figure 12A:
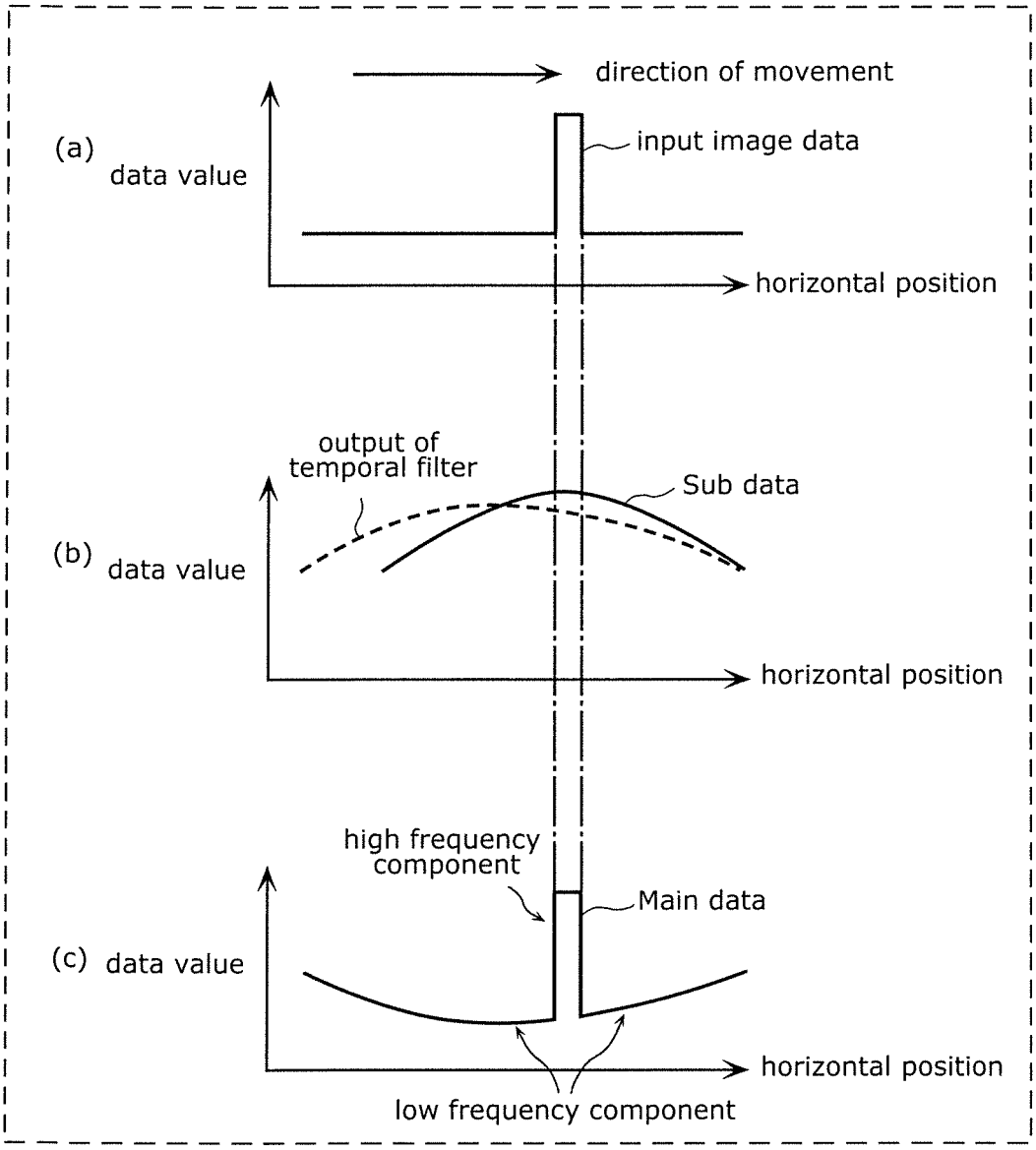
FIG. 12A is a second view illustrating the action when the scroll image is displayed on the liquid crystal display device of the first exemplary embodiment.
Figure 12B:
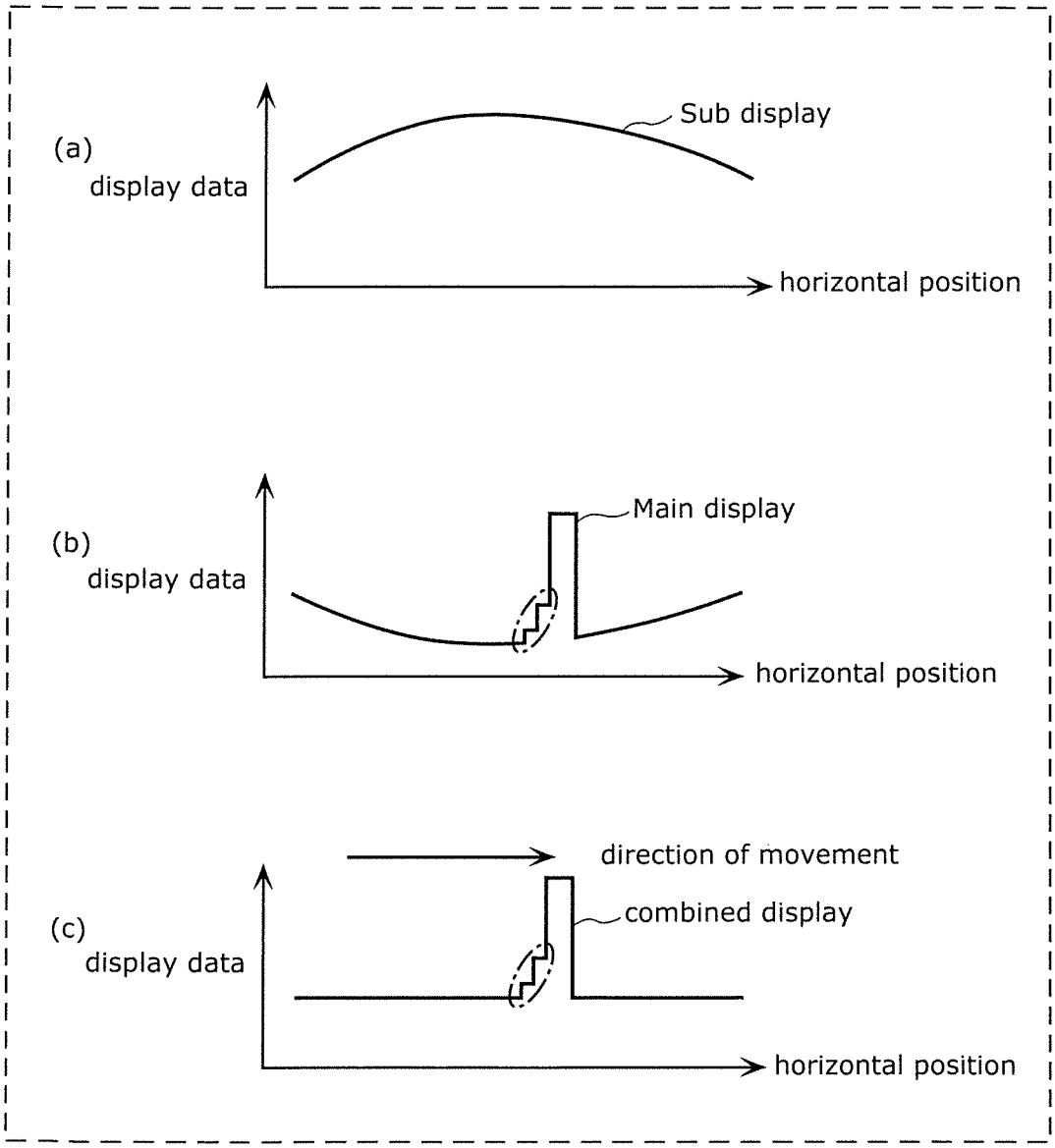
FIG. 12B is a third view illustrating the action when the scroll image is displayed on the liquid crystal display device of the first exemplary embodiment.

With reference to FIGS. 11 to 12B, the case of a scroll image in which the white window moves toward the right side of the paper will be described. FIG. 11 is a first view illustrating an action when the scroll image is displayed on liquid crystal display device 10 of the first exemplary embodiment. Specifically, FIG. 11 illustrates the main display images, the sub display images, and the combined images in liquid crystal display device 10 of the first exemplary embodiment and the liquid crystal display device of the first comparative example.

As illustrated in FIG. 11, temporal filter 85 can delay the speed at which first liquid crystal panel 20 is darkened according to the response speed of second liquid crystal panel 30 in the pixels on the moving direction side of the white window. Temporal filter 85 can delay the speed at which first liquid crystal panel 20 is brightened according to the response speed of second liquid crystal panel 30 in the pixels on the opposite side to the moving direction of the white window. Thus, liquid crystal display device 10 of the first exemplary embodiment can improve both the phenomenon in which the moving direction side of the white window generated in the liquid crystal display device of the first comparative example becomes darker and the phenomenon in which the opposite side to the moving direction of the white window becomes brighter.

FIG. 12A is a second view illustrating the action when the scroll image is displayed on liquid crystal display device 10 of the first exemplary embodiment. Part (a) of FIG. 12A illustrates the data values of the input image. Part (b) of FIG. 12B illustrates the sub data (the gradation value of second output image signal DAT2) output to second liquid crystal panel 30 and the output (the gradation value of the correction signal) of temporal filter 85. Part (c) of FIG. 12A illustrates the main data (the gradation value of the first output image signal DAT1) output to first liquid crystal panel 20. The horizontal axes of parts (a) to (c) in FIG. 12A indicate the horizontal position of liquid crystal display device 10, and the vertical axes indicate the data value.

As illustrated in part (b) of FIG. 12A, second output image signal DAT2 indicating the sub data (solid line) is output to second liquid crystal panel 30. The signal indicating the output (broken line) of temporal filter 85 is output to corrector 90. Temporal filter 85 receives the sub data, and outputs the sub data delayed according to the response speed of second liquid crystal panel 30 to corrector 90 as the output.

Part (c) of FIG. 12A illustrates the main data generated by correcting the signal output from first gamma corrector 81 using corrector 90 based on the output of temporal filter 85 in part (b) of FIG. 12A. As illustrated in part (c) of FIG. 12A, the high-frequency component in the main data is not delayed. The main data is delayed only in the low-frequency region. Consequently, the high-frequency component of first liquid crystal panel 20 is maintained, so that liquid crystal display device 10 can prevent the generation of the flicker and luminance unevenness while preventing the influence on the moving image response.

FIG. 12B is a third view illustrating the action when the scroll image is displayed on liquid crystal display device 10 of the first exemplary embodiment. Part (a) of FIG. 12B illustrates the display data (actual luminance value) of second liquid crystal panel 30 when the sub data in part (b) of FIG. 12A is input. Part (b) of FIG. 12B illustrates the display data (actual luminance value) of first liquid crystal panel 20 when the main data in part (c) of FIG. 12A is input. Part (c) of FIG. 12B illustrates the display data (the luminance value of the combined image) of liquid crystal display device 10. The horizontal axes of parts (a) to (c) of FIG. 12A indicate the horizontal position of liquid crystal display device 10, and the vertical axes indicate the display data.

As illustrated in part (a) of FIG. 12B, even when the sub data in part (b) of FIG. 12A is input, the display data becomes the display data indicated by the sub display due to the influence of the response speed of second liquid crystal panel 30. That is, the display on second liquid crystal panel 30 is delayed from the display indicated by the sub data. For example, the display on second liquid crystal panel 30 becomes the display indicated by the output of temporal filter 85 in part (b) of FIG. 12A.

As illustrated in part (b) of FIG. 12B, the display data is delayed only in the low-frequency region in the high-frequency region and the low-frequency region. In part (b) of FIG. 12B, a portion in which the response of first liquid crystal panel 20 is delayed is indicated by the frame indicated by the alternate long and short dash line.

As illustrated in part (c) of FIG. 12B, in the combined display (combined image), the luminance unevenness is not generated before and after the moving direction of the high-frequency region. Thus, liquid crystal display device 10 of the first exemplary embodiment can prevent the generation of the flicker and luminance unevenness due to the difference of the response speed of the liquid crystal panel while preventing the influence on the moving image response.

[1-2. Operation of Liquid Crystal Display Device]

Figure 13:
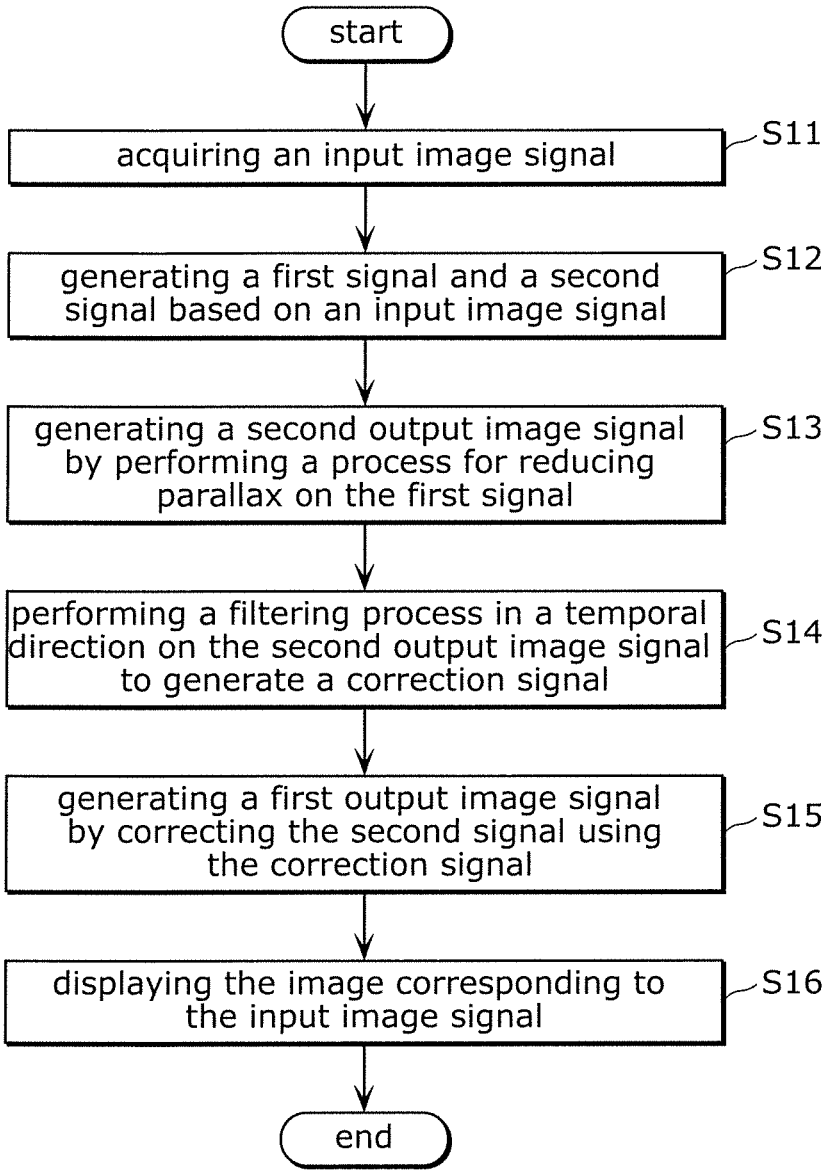
FIG. 13 is a flowchart illustrating operation of the liquid crystal display device of the first exemplary embodiment.

The operation of liquid crystal display device 10 will be described below with reference to FIG. 13. FIG. 13 is a flowchart illustrating the operation of liquid crystal display device 10 of the first exemplary embodiment.

As illustrated in FIG. 13, first, liquid crystal display device 10 acquires input image signal Data (S11). Specifically, image processor 80 acquires input image signal Data by receiving input image signal Data transmitted from an external system (not illustrated). It is assumed that input image signal Data is an image signal used to display the color image. For example, liquid crystal display device 10 acquires input image signal Data as illustrated in part (a) of FIG. 12A.

Image processor 80 generates the second signal based on input image signal Data (S12). Specifically, first gamma corrector 81 generates the second signal by performing the gradation conversion on input image signal Data. First gamma corrector 81 outputs the generated second signal to corrector 90. Second gamma corrector 83 generates the first signal by performing gradation conversion on the black-and-white image data generated by black-and-white image generator 82 based on input image signal Data. Second gamma corrector 83 outputs the generated first signal to parallax reduction unit 84 and corrector 90.

Subsequently, parallax reduction unit 84 generates second output image signal DAT2 by performing the processing of reducing the parallax on the first signal output from second gamma corrector 83 (S13). Parallax reduction unit 84 outputs generated second output image signal DAT2 to second liquid crystal panel 30 and temporal filter 85. For example, second output image signal DAT2 is a signal indicating the sub data (solid line) illustrated in part (b) of FIG. 12A.

Subsequently, temporal filter 85 performs the filtering processing in the temporal direction on second output image signal DAT2, and generates the correction signal (an example of the current-frame correction signal) correcting the second signal (S14). For example, the correction signal is a signal indicating the output (broken line) of temporal filter 85 in part (b) of FIG. 12A. Temporal filter 85 performs the filtering processing in the temporal direction on the sub data (see part (b) of FIG. 12A) subjected to the processing (for example, the low-pass filtering processing) of reducing the parallax by parallax reduction unit 84. Temporal filter 85 performs the filtering processing on the sub data, thereby outputting the sub data with the delay. Temporal filter 85 outputs the generated correction signal (an example of the current frame) to corrector 90.

Subsequently, corrector 90 generates first output image signal DAT1 by correcting the second signal using the current-frame correction signal (S15). Specifically, division processor 91 calculates the correction value used to correct the second signal based on the first signal from second gamma corrector 83 and the correction signal from temporal filter 85. For example, division processor 91 calculates the correction value by dividing the first signal by the correction signal. Division processor 91 outputs the calculated correction value to multiplier 92.

Based on the second signal from first gamma corrector 81 and the correction value from division processor 91, multiplier 92 generates first output image signal DAT1 output to first liquid crystal panel 20. For example, multiplier 92 generates first output image signal DAT1 by multiplying the second signal by the correction value. Multiplier 92 outputs generated first output image signal DAT1 to first liquid crystal panel 20.

Subsequently, liquid crystal display device 10 displays the image corresponding to input image signal Data (S16). For example, liquid crystal display device 10 displays the image of the combined display in part (c) of FIG. 12B. Specifically, second liquid crystal panel 30 displays the image corresponding to second output image signal DAT2, for example, the image of the sub display in part (a) of FIG. 12B. First liquid crystal panel 20 displays the image corresponding to first output image signal DAT1, for example, the image of the main display in part (b) of FIG. 12B. The image displayed on first liquid crystal panel 20 is an image in which only the low-frequency component is delayed. Thus, liquid crystal display device 10 can prevent the generation of the flicker and the luminance unevenness while preventing the generation of the blur in the moving image.

As described above, liquid crystal display device 10 includes first liquid crystal panel 20, second liquid crystal panel 30 that is disposed while superposed on first liquid crystal panel 20, and image processor 80 that generates first output image signal DAT1 output to first liquid crystal panel 20 and second output image signal DAT2 output to second liquid crystal panel 30 based on input image signal Data. Image processor 80 includes parallax reduction unit 84 that receives the first signal based on input image signal Data, performs the smoothing processing on the first signal, and generates second output image signal DAT2, temporal filter 85 that receives second output image signal DAT2 and generates the correction signal determining first output image signal DAT1 based on second output image signal DAT2, and corrector 90 that receives at least the correction signal and the second signal based on input image signal Data and generates first output image signal DAT1 based on at least the correction signal and the second signal. Temporal filter 85 generates the current-frame correction signal based on current-frame second output image signal DAT2 and the previous-frame correction signal.

The parallax reduction signal is an example of the first parallax reduction signal, temporal filter 85 is an example of the first temporal filter, and the correction signal is an example of the first response correction signal.

Consequently, temporal filter 85 generates the correction signal by performing the filtering processing on the signal including the low-frequency component that is subjected to the smoothing processing (for example, the low-pass filtering processing) using parallax reduction unit 84. That is, first output image signal DAT1 is the signal subjected to the correction of the low-frequency component of the second signal based on input image signal Data. The high-frequency component in the second signal is not corrected so much, so that liquid crystal display device 10 can prevent the generation of the moving image blur and the like. Thus, the degradation of the image quality can be prevented even when liquid crystal display device 10 has the configuration including the plurality of liquid crystal panels (for example, first liquid crystal panel 20 and second liquid crystal panel 30). Specifically, liquid crystal display device 10 can prevent such the degradation of the image quality of the moving image as the moving image blur.

When the correction signal is the signal matching the response speed of first liquid crystal panel 20 with the response speed of second liquid crystal panel 30, first output image signal DAT1 generated based on the correction signal becomes the signal subjected to the correction matching the response speed of first liquid crystal panel 20 with the response speed of second liquid crystal panel 30. Consequently, liquid crystal display device 10 can further prevent the generation of the flicker and the luminance unevenness due to the difference in response speed between first liquid crystal panel 20 and second liquid crystal panel 30.

The first signal is also input to corrector 90. Corrector 90 includes division processor 91 that calculates the correction value based on the first signal and the correction signal and multiplier 92 that generates first output image signal DAT1 based on the correction value and the second signal.

Consequently, the calculated correction value becomes the value reflecting the pieces of processing of parallax reduction unit 84 and temporal filter 85. That is, first output image signal DAT1 becomes the signal reflecting the pieces of processing of parallax reduction unit 84 and temporal filter 85. Thus, the generation of the degradation of the image quality due to the performance of the pieces of processing of parallax reduction unit 84 and temporal filter 85 can be prevented.

Temporal filter 85 performs the filtering processing using time constant K1 corresponding to the difference in response speed between first liquid crystal panel 20 and second liquid crystal panel 30.

Time constant K1 is an example of the filter coefficient.

Consequently, image processor 80 can bring the response difference between first liquid crystal panel 20 and second liquid crystal panel 30 closer to zero. Thus, liquid crystal display device 10 can further prevent the generation of the flicker and the luminance unevenness due to the difference in response speed between first liquid crystal panel 20 and second liquid crystal panel 30.

Temporal filter 85 performs the filtering processing using the look-up table in which the input value of second output image signal DAT2, the output value of the past-frame correction signal, and the output value of the current-frame correction signal are associated with each other.

The look-up table is an example of the conversion table.

Consequently, a processing amount in temporal filter 85 can be suppressed.

Image processor 80 further includes second gamma corrector 83 that generates the first signal by correcting the gradation value of input image signal Data according to the gamma characteristic of second liquid crystal panel 30.

Second gamma corrector 83 is an example of the gradation corrector.

Consequently, various pieces of processing can be performed on the signal in consideration of the gamma characteristic of second liquid crystal panel 30. That is, second output image signal DAT2 becomes the signal in consideration of the gamma characteristic of second liquid crystal panel 30. Thus, second liquid crystal panel 30 can perform the more desired display.

First liquid crystal panel 20 displays the color image, and second liquid crystal panel 30 is disposed on the back surface side of first liquid crystal panel 20 to display the monochrome image.

Consequently, it is possible to prevent the generation of the flicker and the luminance unevenness due to the difference in response speed between first liquid crystal panel 20 and second liquid crystal panel 30 in liquid crystal display device 10 in which first liquid crystal panel 20 displays the color image while second liquid crystal panel 30 displays the monochrome image.

Modification of First Exemplary Embodiment

Figure 14:
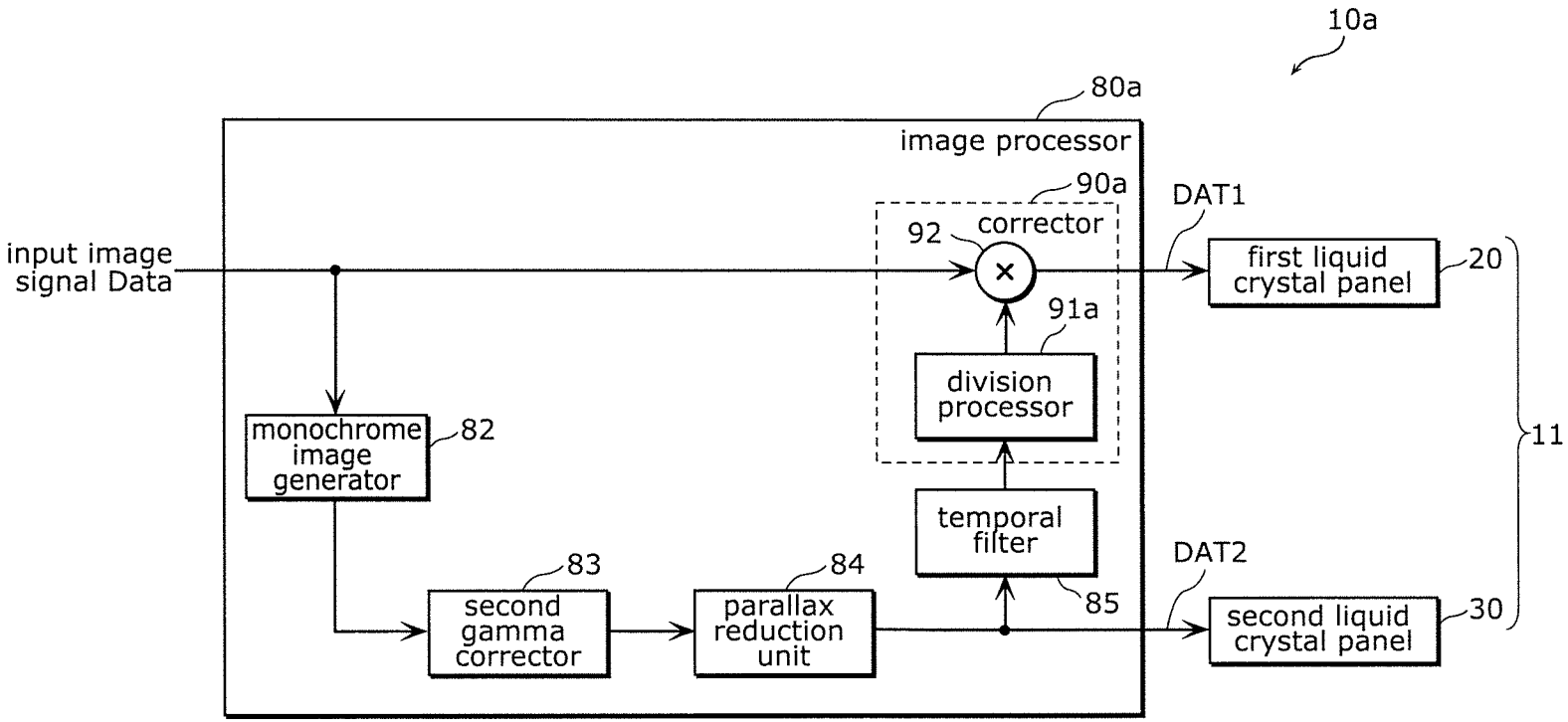
FIG. 14 is a block diagram illustrating a functional configuration of an image processor according to a modification of the first exemplary embodiment.

Liquid crystal display device 10*a* according to a modification will be described below with reference to FIG. 14. FIG. 14 is a block diagram illustrating a configuration of image processor 80*a* according to the modification of the first exemplary embodiment. Image processor 80*a* of the modification is different from image processor 80 of the first exemplary embodiment in that image processor 80*a* does not includes first gamma corrector 81, and that image processor 80*a* includes corrector 90*a* instead of corrector 90. Image processor 80*a* of the modification will be described below while focusing on a difference from image processor 80 of the first exemplary embodiment. In the modification, the same or similar configuration as image processor 80 of the first exemplary embodiment is denoted by the same reference numeral as image processor 80, and the description is omitted or simplified.

As illustrated in FIG. 14, image processor 80*a* included in liquid crystal display device 10*a* does not include first gamma corrector 81. For this reason, in image processor 80*a*, input image signal Data is directly input to corrector 90*a*. In this way, the second signal based on input image signal Data may be input image signal Data itself.

Division processor 91*a* calculates the correction value used to correct the gradation value in each pixel of input image signal Data based on the correction signal (an example of the current-frame correction signal) output from temporal filter 85. For example, division processor 91*a* outputs the correction value indicating a reciprocal of the gradation value of the correction signal to multiplier 92. Multiplier 92 generates first output image signal DAT1 by correcting the gradation value of input image signal Data using the correction value. Corrector 90*a* outputs generated first output image signal DAT1 to first liquid crystal panel 20.

In this case, assuming that Ds is the gradation value of the second output image signal DAT2 and that D is the gradation value of input image signal Data, gradation value Dm of first output image signal DAT1 is given by the following equation 7.

$$Dm=D/Ds \quad \text{(equation 7)}$$

In this case, the gamma value on the side of first liquid crystal panel 20 becomes (1−gamma value r2).

As described above, in liquid crystal display device 10*a*, the second signal is input image signal Data.

Consequently, liquid crystal display device 10*a* has the simple configuration in which first gamma corrector 81 is not included. Even in liquid crystal display device 10*a*, liquid crystal display device 10*a* includes temporal filter 85, which allows the generation of the flicker and the luminance unevenness to be prevented. Thus, liquid crystal display device 10*a* has the simple configuration, and the degradation of the image quality due to the difference in response speed can be prevented even when the response speed varies for each of the plurality of liquid crystal panels (for example, first liquid crystal panel 20 and second liquid crystal panel 30).

Second Exemplary Embodiment

Liquid crystal display device 110 according to a second exemplary embodiment will be described below with reference to FIGS. 15 to 19.

Figure 15:
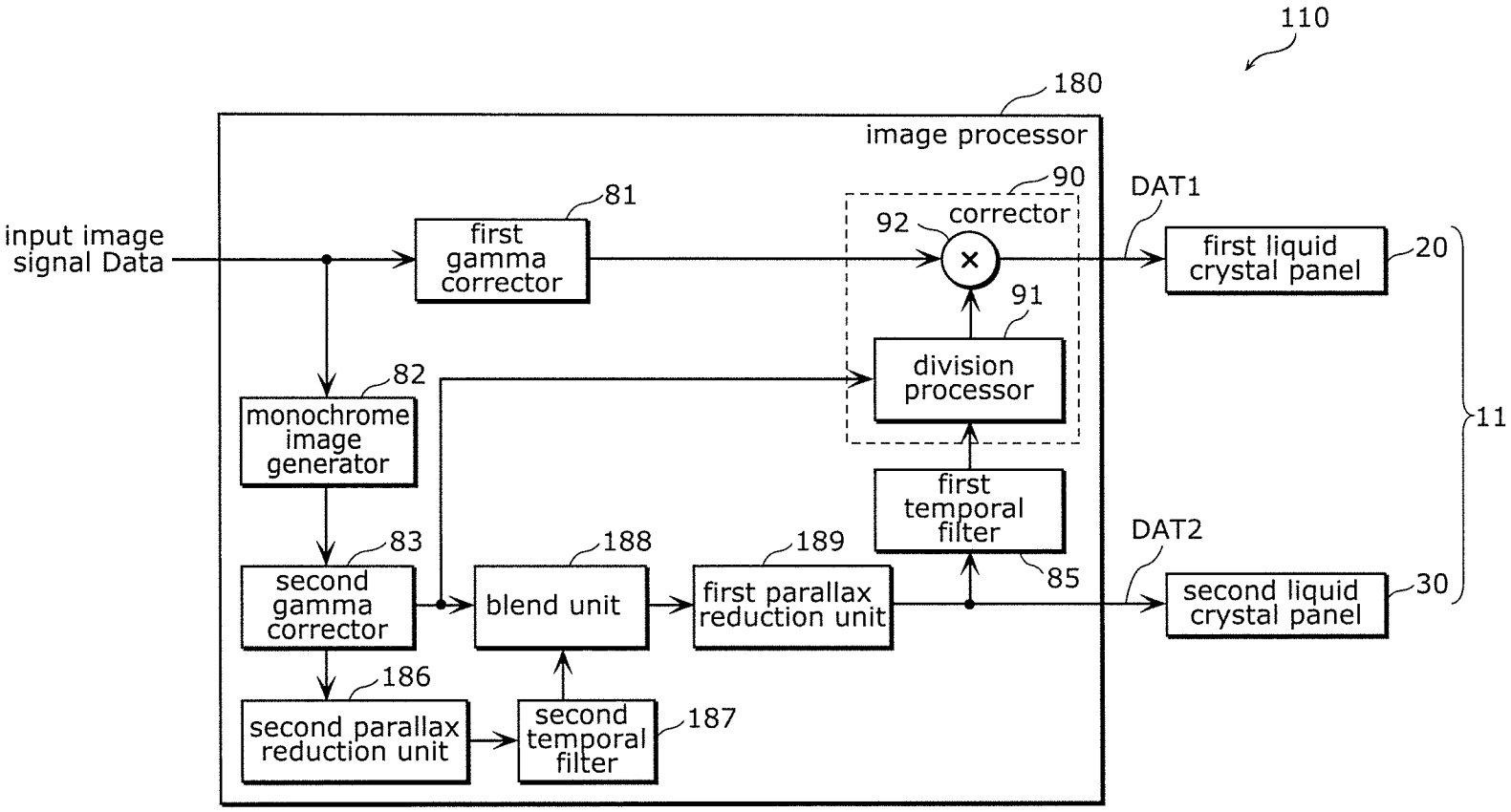
FIG. 15 is a block diagram illustrating a functional configuration of an image processor according to a second exemplary embodiment.

[2-1. Configuration of Liquid Crystal Display Device] A schematic configuration of liquid crystal display device 110 of the second exemplary embodiment will be described below with reference to FIGS. 15 to 19. FIG. 15 is a block diagram illustrating a functional configuration of image processor 180 of the second exemplary embodiment. Liquid crystal display device 110 of the second exemplary embodiment is characterized in that the generation of the flicker and the luminance unevenness can be prevented even when the response difference changes due to the temperature change.

Image processor 180 is mainly different from image processor 80 of the first exemplary embodiment in that image processor 180 includes second parallax reduction unit 186, second temporal filter 187, and blending unit 188. Image processor 180 of the second exemplary embodiment will be described below while focusing on the difference from image processor 80 of the first exemplary embodiment. In the second exemplary embodiment, the same or similar configuration as image processor 80 of the first exemplary embodiment is denoted by the same reference numeral as image processor 80, and the description is omitted or simplified.

As illustrated in FIG. 15, image processor 180 of liquid crystal display device 110 includes second parallax reduction unit 186, second temporal filter 187, and blending unit 188 in addition to image processor 80 of the first exemplary embodiment. Image processor 180 includes first parallax reduction unit 189 instead of parallax reduction unit 84. First temporal filter 85 is the same filter as the temporal filter of the first exemplary embodiment, but is referred to as first temporal filter 85 for discrimination from second temporal filter 187.

Second parallax reduction unit 186 receives gradation-corrected input image signal Data (for example, gradation-corrected black-and-white image data) output from second gamma corrector 83, performs smoothing processing on gradation-corrected input image signal Data, and generates the second parallax reduction signal. For example, second parallax reduction unit 186 performs the correction reducing the parallax between the first image based on first output image signal DAT1 and the second image based on second output image signal DAT2 on input image signal Data that is output form second gamma corrector 83 and subjected to the gradation correction. The filter size used for the low-pass filtering processing of the second parallax reduction unit 186 is larger than the filter size used for the low-pass filtering processing of first parallax reduction unit 189. For example, second parallax reduction unit 186 is a large-area filter. For example, second parallax reduction unit 186 has the filter size of 300 pixels×300 pixels, but is not limited to the filter size of 300 pixels×300 pixels. Second parallax reduction section 186 has the large filter size, the parallax can further be reduced. For example, second parallax reduction unit 186 is constructed with a low-pass filter such as what is called a MAX filter or a Gaussian filter. Input image signal Data (specifically, the black-and-white image data subjected to the gradation correction) subjected to the gradation correction of second gamma corrector 83 is an example of the third signal based on input image signal Data, and the low-pass filter is an example of the smoothing filter.

Figure 16:
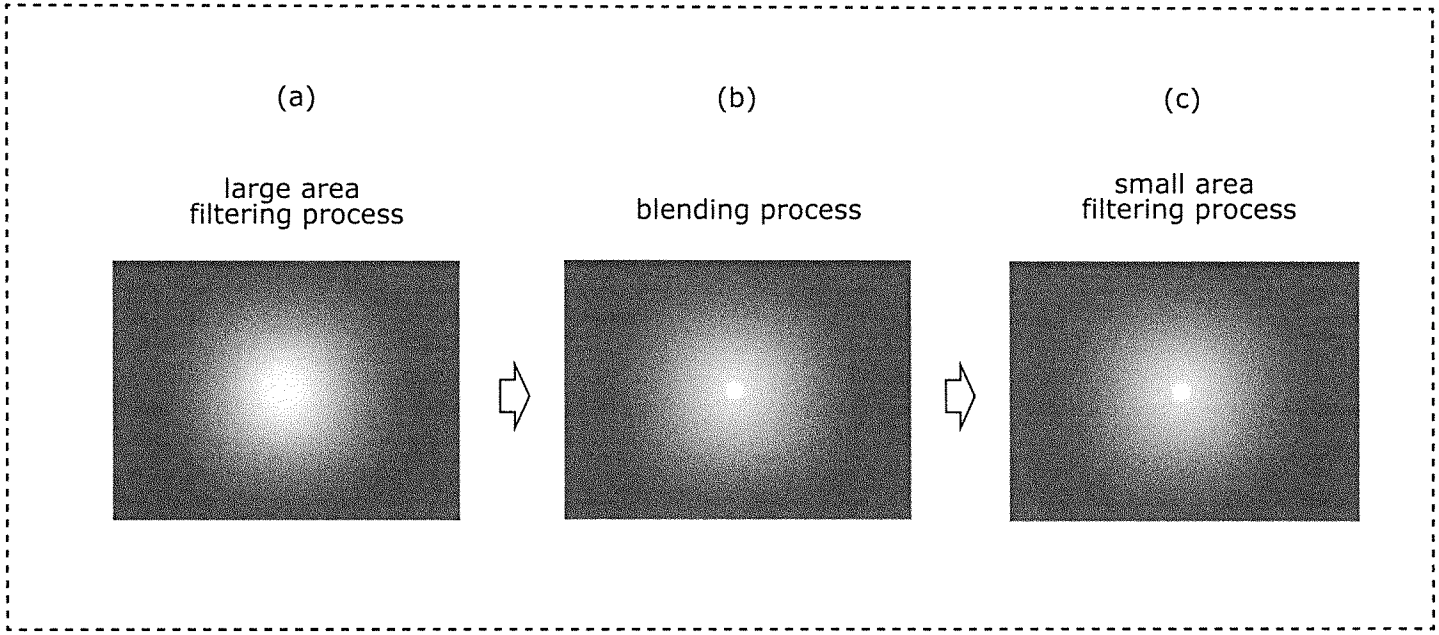
FIG. 16 is a view schematically illustrating an image based on a signal subjected to various pieces of processing of the second exemplary embodiment.

FIG. 16 is a view schematically illustrating the image based on the signal subjected to various pieces of processing of the second exemplary embodiment. Part (a) of FIG. 16 schematically illustrates the image obtained by performing the filtering processing (large-screen filtering processing in FIG. 16) on the input image illustrated in the first frame of FIG. 6 using second parallax reduction unit 186.

As illustrated in part (a) of FIG. 16, the large screen filtering processing is performed on the input image to improve the parallax.

With reference to FIG. 15 again, second parallax reduction unit 186 outputs the second parallax reduction signal generated based on the black-and-white image data to second temporal filter 187.

When second parallax reduction unit 186 has the large filter size, the effect that prevents the parallax is improved, but sometimes the flicker and the luminance unevenness are conspicuous. For this reason, in the second exemplary embodiment, second temporal filter 187 is provided in order to prevent the generation of the flicker and the luminance unevenness due to the filtering processing of second parallax reduction unit 186.

Second temporal filter 187 generates the second response correction signal preventing the generation of the flicker and the luminance unevenness due to the filtering processing of second parallax reduction unit 186. The second response correction signal is a signal based on the second parallax reduction signal, and is a signal delaying the response of second liquid crystal panel 30. It can be said that the second response correction signal is a signal delaying the response of the display image on second liquid crystal panel 30 (specifically, delaying the response in the low-frequency region of the display image of second liquid crystal panel 30). For example, the second response correction signal is a signal obtained by delaying the luminance change of the low-frequency component in the second parallax reduction signal.

Second temporal filter 187 generates the second response correction signal using the second parallax reduction signal output from second parallax reduction unit 186. It can be said that second temporal filter 187 generates the second response correction signal using the second parallax reduction signal subjected to the large screen filtering processing. Specifically, second temporal filter 187 generates the current-frame second response correction signal by performing the filtering processing in the temporal direction using the current-frame second disparity reduction signal and the second response correction signal (an example of the output signal) output from second temporal filter 187 to blending unit 188 in the past frame.

Consequently, the sudden change in luminance value can be prevented in second liquid crystal panel 30. Specifically, second temporal filter 187 prevents the temporal change in luminance in the low-frequency region of the sub display image displayed on second liquid crystal panel 30.

The filtering processing of second temporal filter 187 will be described below. Assuming that VI2*n*(i, j) is the second parallax reduction signal of at pixel position (i, j) of the n-th frame, that VO2*n*−1(i, j) the output data of second temporal filter 187 at pixel position (i, j) of the (n−1)-th frame, and that K4 is a time constant, output data VO2*n*(i, j) of second temporal filter 187 at pixel position (i, j) of the n-th frame is given by the following equation 8.

$$VO2n(i,j)=\{VI2n(i,j)-VO2n-1(i,j)\}\times K4+VO2n-1(i,j) \quad \text{(equation 8)}$$

As illustrated in the equation 8, second temporal filter 187 calculates the current-frame output data (an example of the current-frame second response correction signal) using the current-frame input data (an example of the current-frame second parallax reduction signal) and the past-frame output data (an example of the past-frame second response correction signal). In other words, second temporal filter 187 performs such the processing that the past-frame output data affects the current-frame output data. In the second exemplary embodiment, second temporal filter 187 is configured such that the immediately preceding-frame output data affects the next-frame output data.

For example, time constant K4 of second temporal filter 187 is set to a value smaller than 1. Second temporal filter 187 performs the filtering processing so as to delay the response of second liquid crystal panel 30. As described above, second temporal filter 187 adjusts the value of time constant K4, and brings the difference in response between first liquid crystal panel 20 and second liquid crystal panel 30 close to zero even when the temperature changes.

For example, the response speeds of first liquid crystal panel 20 and second liquid crystal panel 30 are measured, and time constant K4 may previously be set based on the measurement result. For example, time constant K4 may be set to a predetermined value. Time constant K4 is an example of the filter coefficient.

For example, the low-pass filter having the IIR filter configuration can be applied to second temporal filter 187. For example, second temporal filter 187 may be the low-pass filter having the IIR filter configuration of the first-order lag system. Second temporal filter 187 is not limited to the low-pass filter having the IIR filter configuration. For example, second temporal filter 187 may be a low-pass filter having an FIR filter configuration. For example, second temporal filter 187 may be a median filter or the like.

Image processor 80 includes a frame memory (not illustrated) that stores the output data of second temporal filter 187 in the past frame. For example, second temporal filter 187 may include the frame memory.

Second temporal filter 187 is not limited to the use of the approximate equation such as the equation 8. For example, second temporal filter 187 may generate the current-frame second response correction signal by calculating the output value using the look-up table.

Blending unit 188 combines the signal that is output from second gamma corrector 83 and the signal output from second temporal filter 187 while maintaining the maximum luminance. For example, blending unit 188 adds two signals at a predetermined ratio based on the maximum value of the luminance of the two signals. In other words, blending unit 188 adds the current-frame black-and-white image data subjected to the gradation correction by second gamma corrector 83 and the current-frame second response correction signal with a predetermined weight.

Assuming that D11 is the gradation value of the signal output from second gamma corrector 83, and that D12 is the gradation value of the signal output from second temporal filter 187, for example, blending unit 188 calculates gradation value D10 of the signal output to first parallax reduction unit 189 using the following equation 9.

$$D10=(1-\alpha)\times D11+\alpha\times D12 \quad \text{(equation 9)}$$

Where α is a coefficient (weight), and is an example of the predetermined weight. For example, coefficient α is a value of 1 or less. Blending unit 188 may determine coefficient α based on input image signal Data. For example, blending unit 188 may determine coefficient α according to the brightness of the image indicated by input image signal Data. For example, when the image indicated by input image signal Data is the bright image, blending unit 188 determines coefficient α larger than that of the dark image. Blending unit 188 determines coefficient α such that the influence of the signal from second temporal filter 187 becomes large in a bright scene. It can be said that blending unit 188 determines the weight (α) of gradation value D12 to be a larger value when the image indicated by input image signal Data is the brighter image. For example, when the image indicated by input image signal Data is the bright image, blending unit 188 may determine coefficient α such that the weight of the current-frame second response correction signal is larger than the weight of the current-frame black-and-white image data subjected to the gradation correction.

For example, when the image indicated by input image signal Data is the dark image, blending unit 188 determines coefficient α smaller than that of the bright image. Blending unit 188 determines coefficient α such that the influence of the signal of second gamma corrector 83 becomes large in a dark scene. It can be said that blending unit 188 determines the weight (1−α) of gradation value D11 to be a larger value when the image indicated by input image signal Data is the darker image. For example, when the image indicated by input image signal Data is the dark image, blending unit 188 may determine coefficient α such that the weight of the current-frame black-and-white image data subjected to the gradation correction is larger than the weight of the current-frame second response correction signal.

The determination of coefficient α is an example, and the present disclosure is not limited to this determination. For example, coefficient α may be a previously-set value.

For example, the term "bright" means that one of a maximum value, an average value, a median value, and a minimum value of the gradation values (gradation value for each pixel) in the image is larger than a predetermined gradation value. Also, for example, the term "bright" may be that the image is divided into a plurality of areas and one of the maximum value, the average value, the median value, and the minimum value of the gradation values of the plurality of pixels in the divided area is larger than a predetermined gradation value. In this case, blending unit 188 may determine coefficient α for each of the plurality of areas. For example, when a dark area having the brightness less than or equal to a predetermined brightness among the plurality of areas, blending unit 188 may set coefficient α of the area (for example, the area adjacent to the dark area) surrounding the dark area to a value smaller than coefficient α determined based on the brightness of the surrounding area. Consequently, the generation of black floating due to the influence of the bright area surround the dark area can be prevented in the image having the locally dark area. That is, the degradation of the image quality can further be prevented. The predetermined gradation value is an example of the predetermined brightness.

Part (b) of FIG. 16 illustrates the image in which the image based on the signal output from second gamma corrector 83 and the image based on the signal output from second temporal filter 187 are combined with a predetermined mixture ratio (blending processing in FIG. 16). At this point, the maximum luminance is maintained. That is, the maximum luminance of the image generated by the combination is equal to the maximum luminance of the input image.

With reference to FIG. 15 again, blending unit 188 outputs the generated signal to first parallax reduction unit 189. The signal output from blending unit 188 to first parallax reduction unit 189 is an example of the first signal based on input image signal Data.

First parallax reduction unit 189 performs the correction reducing the parallax between the first image based on first output image signal DAT1 and the second image based on second output image signal DAT2 on the signal output from blending unit 188. First parallax reduction unit 189 is a filter having a filter size smaller than that of second parallax reduction unit 186. For example, second parallax reduction unit 186 is a small-area filter. For example, first parallax reduction unit 189 has the filter size of about 10 pixels×10 pixels, but is not limited to the filter size of about 10 pixels×10 pixels. First parallax reduction unit 189 has the small filter size, so that the parallax can be further reduced while preventing the generation of the flicker and the luminance unevenness. For example, first parallax reduction unit 189 is constructed with a low-pass filter such as what is called a MAX filter or a Gaussian filter. For example, first parallax reduction unit 189 performs small-area filtering processing on the signal output from blending unit 188 as illustrated in part (c) of FIG. 16.

With reference to FIG. 15 again, first parallax reduction unit 189 outputs the second parallax reduction signal generated based on the signal from blending unit 188 to first temporal filter 85 and second liquid crystal panel 30. The second parallax reduction signal is an example of second output image signal DAT2.

Image processor 180 having the above configuration slowly changes the gradation value in the low-frequency region of second output image signal DAT2 output to second liquid crystal panel 30 by the filtering processing of second temporal filter 187. As a result, the low-frequency region of the sub display image displayed on second liquid crystal panel 30 changes slowly (see FIG. 19 described later).

Corrector 90 corrects first output image signal DAT1 while maintaining a relationship that input image signal Data is obtained by multiplying first output image signal DAT1 and second output image signal DAT2. Specifically, corrector 90 performs the correction so as to slowly change the gradation value in the low-frequency region of first output image signal DAT1 output to first liquid crystal panel 20.

Consequently, in liquid crystal display device 110, even when the response difference of the response speed between first liquid crystal panel 20 and second liquid crystal panel 30 changes due to the temperature change, the generation of the flicker and the luminance unevenness due to the temperature change can be prevented by slowly changing the luminance values in the low-frequency regions of first liquid crystal panel 20 and second liquid crystal panel 30.

Figure 17:
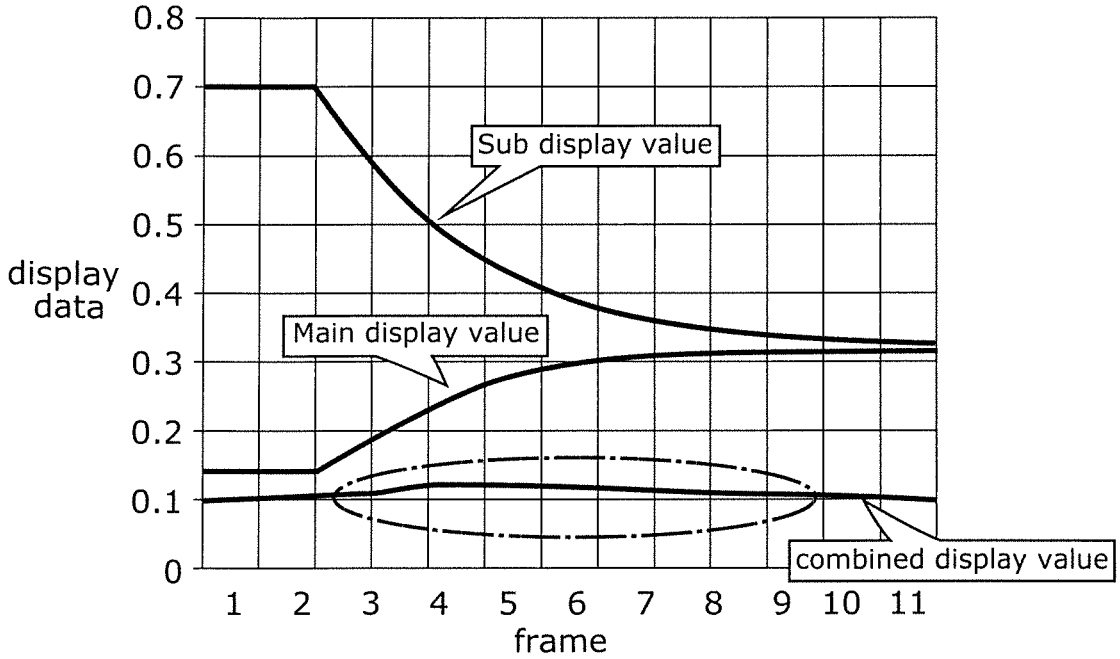
FIG. 17 is a view illustrating an example of display data of a liquid crystal display device according to a second comparative example.

With reference to FIG. 17, the case where the temperature changes in the liquid crystal display device that does not include second temporal filter 187 will be described below. FIG. 17 is a view illustrating an example of display data of a liquid crystal display device according to a second comparative example. The liquid crystal display device of the second comparative example is a liquid crystal display device that includes first temporal filter 85 in FIG. 15 and does not include second temporal filter 187. For example, the liquid crystal display device of the second comparative example may be liquid crystal display device 10 of the first exemplary embodiment. An example in which the liquid crystal display device of the second comparative example is liquid crystal display device 10 of the first exemplary embodiment will be described below. FIG. 17 illustrates the display data at point P in FIG. 18.

In the first exemplary embodiment, at the first temperature, assuming that first liquid crystal panel 20 has time constant K21 of 0.875, that second liquid crystal panel 30 has time constant K22 of 0.5, and that temporal filter 85 has time constant K1 of 0.54, the responses of first liquid crystal panel 20 and second liquid crystal panel 30 are matched with each other (see the solid line in FIG. 8). FIG. 17 is a view illustrating an example of the display data when the response speeds of first liquid crystal panel 20 and second liquid crystal panel 30 change by the change of an ambient temperature from the first temperature to the second temperature, when first temporal filter 85 is maintained at time constant K1 of 0.54, when first liquid crystal panel 20 changes to time constant K21 of 0.8 and when second liquid crystal panel 30 changes to time constant K22 of 0.3.

As illustrated in FIG. 8, at the first temperature, the responses of first liquid crystal panel 20 and second liquid crystal panel 30 are matched with each other by the filtering processing of first temporal filter 85. However, as can be seen from FIG. 17, at the second temperature, because the time constant of the liquid crystal panel changes due to the change in the response speed of the liquid crystal panel, the response of first liquid crystal panel 20 cannot appropriately be corrected while first temporal filter 85 is maintained at time constant K1 of 0.54. As a result, in the liquid crystal display device of the second comparative example, as indicated by the frame of the alternate long and short dash line, sometimes the flicker displayed brighter than an original one is generated in the frames from the third frame.

Figure 18:
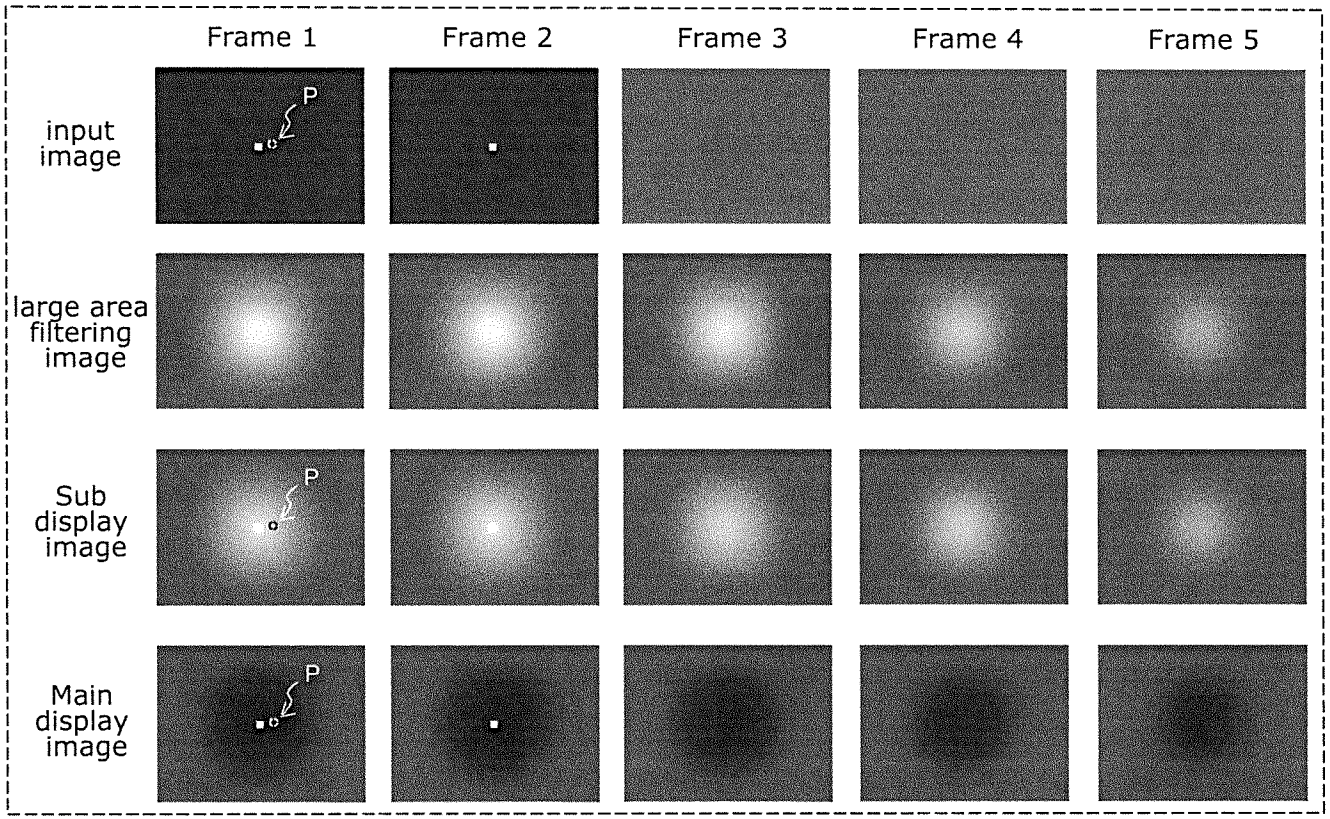
FIG. 18 is a view illustrating an example of a display image of the liquid crystal display device according to the second exemplary embodiment.
Figure 19:
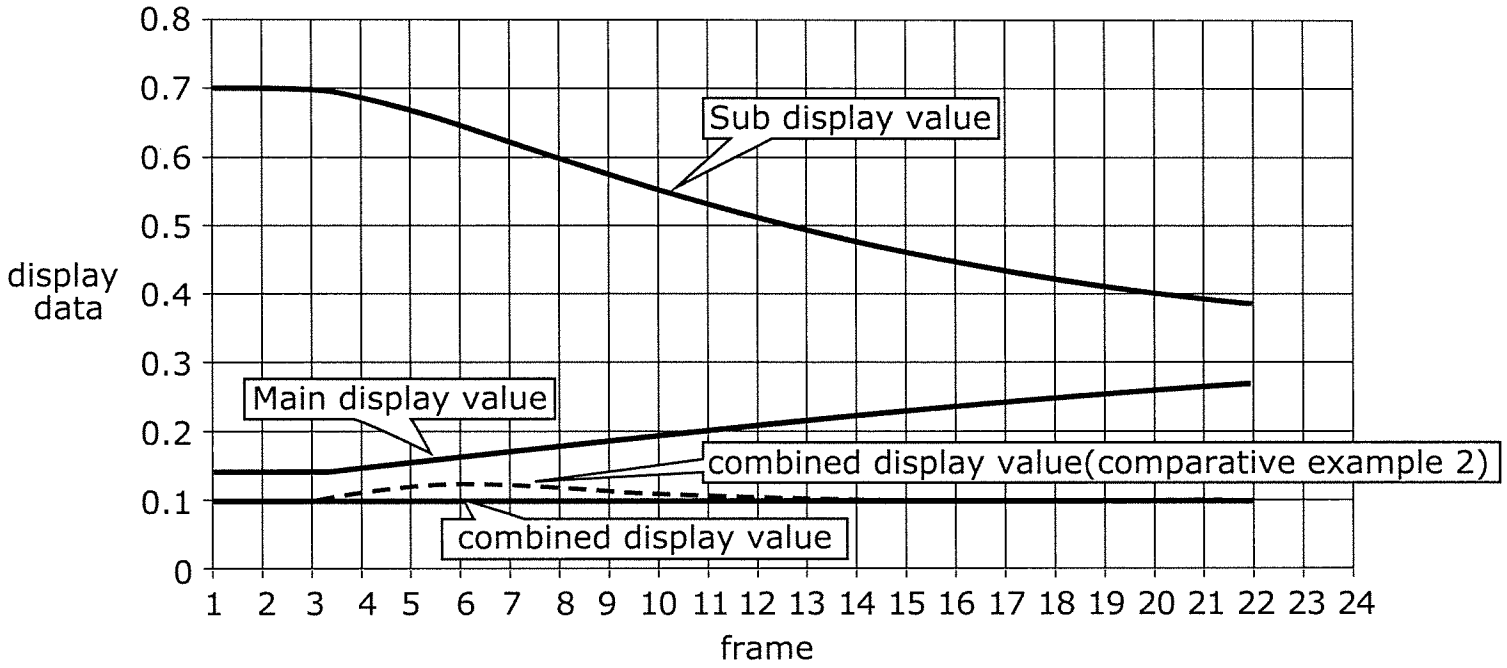
FIG. 19 is a view illustrating an example of display data of the liquid crystal display device according to the second exemplary embodiment.

On the other hand, liquid crystal display device 110 of the second exemplary embodiment includes second temporal filter 187, so that the flicker and the luminance unevenness due to the temperature change can be prevented. With reference to FIGS. 18 and 19, the prevention of the flicker and the luminance unevenness due to the temperature change will be described below.

FIG. 18 is a view illustrating an example of the display image of liquid crystal display device 110 of the second exemplary embodiment. Specifically, FIG. 18 schematically illustrates the input image, a large-area filtering image, the sub display image, and the main display image in five frames from the first frame to the fifth frame. The large-area filtering image is the image based on the signal output from second parallax reduction unit 186.

FIG. 19 is a view illustrating an example of the display data of liquid crystal display device 110 of the second exemplary embodiment. In FIG. 19, the horizontal axis indicates the frame, and the vertical axis indicates the display data (gradation value). A broken line indicates a luminance transition when second temporal filter 187 is not included, and a solid line indicates a luminance transition when second temporal filter 187 is included.

As illustrated in FIGS. 18 and 19, liquid crystal display device 110 includes second temporal filter 187, so that the responses in the low-frequency regions of the main display image displayed on first liquid crystal panel 20 and the sub display image displayed on second liquid crystal panel 30 can be delayed. That is, liquid crystal display device 110 can delay the display reflesh speed s in the low-frequency regions of the main display image and the sub display image.

The display is switched from the second frame to the third frame in FIG. 18, but the switching is not completed at time of the fifth frame. In liquid crystal display device 110, for example, in the low-frequency region, it takes long time to actually switch the display compared with the case of FIG. 10.

As illustrated in FIG. 19, liquid crystal display device 110 can prevent the flicker of the display image by preventing the change of the sub data in the large area using second temporal filter 187. The sub data changes slowly, and the main data also follows the change of the sub data while sub data×main data=input image signal is maintained. Consequently, even when the response difference between first liquid crystal panel 20 and second liquid crystal panel 30 changes due to the temperature change or the like, liquid crystal display device 110 can prevent the flicker that finally appears in the display image. For example, liquid crystal display device 110 can prevent the flicker due to the temperature change without performing the control using a temperature sensor, namely, while a cost increase is prevented. Similarly, when the scroll image of the white window is displayed, the sub data and the main data change slowly in the low-frequency region, so that liquid crystal display device 110 can prevent the luminance unevenness due to the temperature change.

The configuration of liquid crystal display device 110 is not limited to the above configuration. For example, liquid crystal display device 110 may include at least one of first gamma corrector 81 or second gamma corrector 83. Liquid crystal display device 110 may not include first parallax reduction unit 189. In this case, second parallax reduction unit 186 functions as the first parallax reduction unit that generates the parallax reduction signal (an example of the first parallax reduction signal) by performing the correction reducing the parallax between the first image based on first output image signal DAT1 and the second image based on second output image signal DAT2 on the black-and-white image data subjected to the gradation-correction.

As described above, liquid crystal display device 110 includes second parallax reduction unit 186 that generates the second parallax reduction signal by performing the correction reducing the parallax between the first image based on first output image signal DAT1 and the second image based on second output image signal DAT2 on the third signal based on input image signal Data, second temporal filter 187 that generates the current-frame second response correction signal by performing the filtering processing in the temporal direction using the second parallax reduction signal and the past-frame second response correction signal delaying the response speed of second liquid crystal panel 30, and blending unit 188 that generates the first signal by adding the three signal and the current-frame second response correction signal with the predetermined weight.

Consequently, second temporal filter 187 can delay the low-frequency region of the black-and-white image data from second gamma corrector 83. That is, second temporal filter 187 is included, which slowly switches the display of second liquid crystal panel 30 in the low-frequency region. Along with this, the display on first liquid crystal panel 20 is also slowly switched in the low-frequency region by the correction of corrector 90. Thus, even when the response difference between first liquid crystal panel 20 and second liquid crystal panel 30 changes due to the temperature change, liquid crystal display device 110 can prevent the generation of the flicker and the luminance unevenness due to the temperature by the slow switching of the display in the low-frequency region. That is, in liquid crystal display device 110, the degradation of the image quality can further be prevented without adding another configuration such as a temperature sensor, namely, while the cost increase is prevented. The image displayed by liquid crystal display device 110 can maintain the maximum luminance of the input image.

Second parallax reduction unit 186 has a filter size larger than that of first parallax reduction unit 189.

Consequently, second parallax reduction unit 186 can further improve the parallax as compared with the small-size filter. Although the parallax is improved by increasing the filter size of the second parallax reduction unit 186, the flicker and the luminance unevenness becomes conspicuous. However, the existence of second temporal filter 187 can prevent the generation of the flicker and the luminance unevenness. Thus, in liquid crystal display device 110, the parallax can further be reduced while the generation of the flicker and the luminance unevenness is prevented, so that the image quality can further be improved.

Blending unit 188 determines a predetermined weight according to the brightness of the image indicated by input image signal Data.

Consequently, the weight changes according to the brightness of the image. Liquid crystal display device 110 can further prevent the generation of the flicker and the luminance unevenness due to the temperature change by appropriately setting the weight according to the brightness of the image.

Blending unit 188 determines the predetermined weight such that the weight of the current-frame second response correction signal becomes larger in the third signal and the current-frame second response correction signal when the image has the brightness greater than or equal to the predetermined brightness, and blending unit 188 determines the predetermined weight such that the weight of the third signal becomes larger in the third signal and the current-frame second response correction signal when the brightness of the image indicated by input image signal Data is lower than the predetermined brightness.

Consequently, for the bright image, liquid crystal display device 110 can effectively prevent the parallax by increasing the influence of large-area second parallax reduction unit 186. For the dark image, liquid crystal display device 110 can prevent the black floating in the dark image by increasing the influence of the signal from second gamma corrector 83.

Liquid crystal display device 110 further includes second gamma corrector 83 that generates the third signal by correcting the gradation value of input image signal Data according to the gamma characteristic of second liquid crystal panel 30.

Second gamma corrector 83 is an example of the gradation corrector.

Consequently, various pieces of processing can be performed on the signal in consideration of the gamma characteristic of second liquid crystal panel 30. That is, second output image signal DAT2 becomes the signal in consideration of the gamma characteristic of second liquid crystal panel 30. Thus, second liquid crystal panel 30 can perform the more desired display.

Third Exemplary Embodiment

Figure 20:
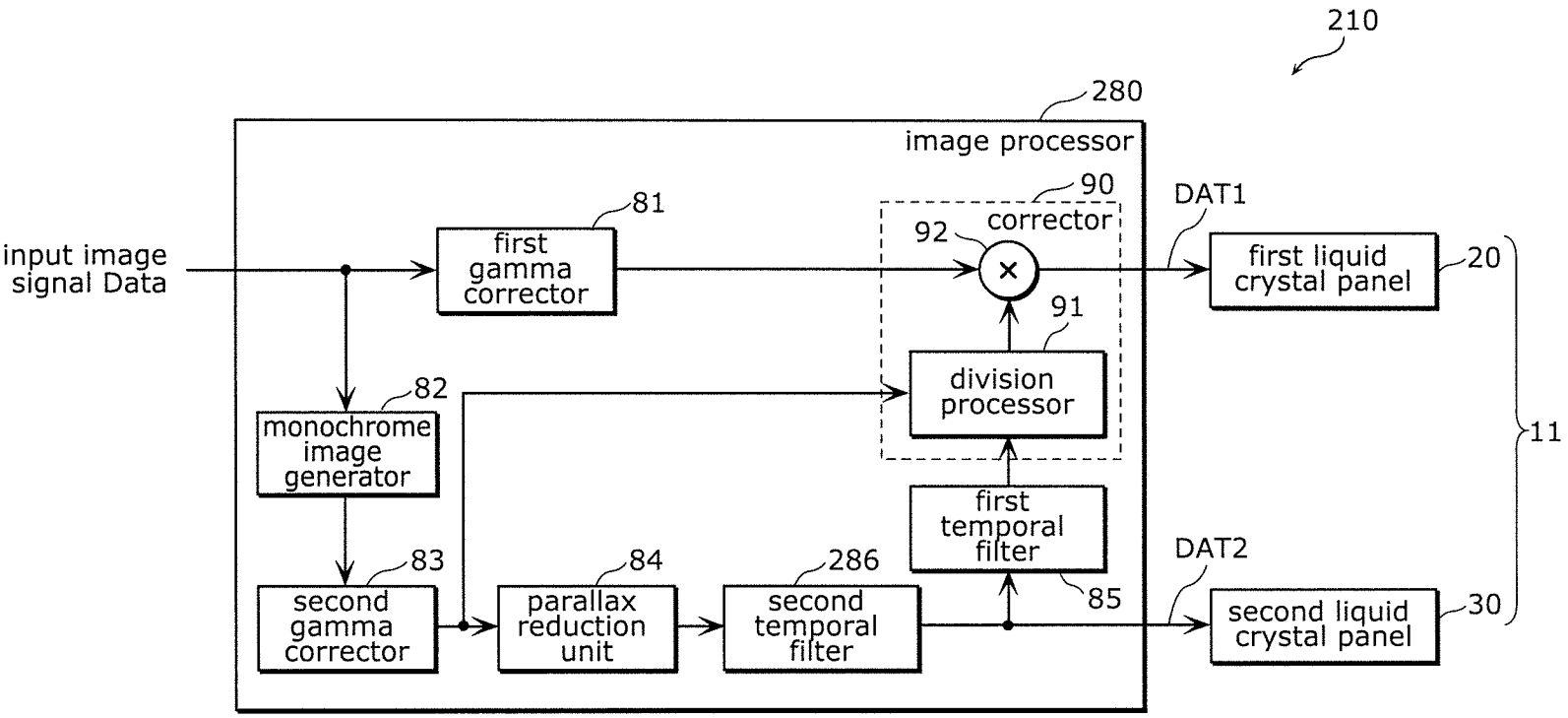
FIG. 20 is a block diagram illustrating a functional configuration of an image processor according to a third exemplary embodiment.

With reference to FIG. 20, liquid crystal display device 210 according to a third exemplary embodiment will be described below.

[3-1. Configuration of Liquid Crystal Display Device]

A schematic configuration of liquid crystal display device 210 of the third exemplary embodiment will be described with reference to FIG. 20. FIG. 20 is a block diagram illustrating a functional configuration of image processor 280 of the third exemplary embodiment. Liquid crystal display device 210 of the third exemplary embodiment is characterized in that the generation of the flicker and the luminance unevenness can be prevented with the simple configuration even when the response difference changes due to the temperature change.

Image processor 280 is mainly different from image processor 80 of the first embodiment in that image processor 280 includes second temporal filter 286. Image processor 280 of the third exemplary embodiment will be described below while focusing on differences from image processor 80 of the first exemplary embodiment. In the second exemplary embodiment, the same or similar configuration as image processor 80 of the first exemplary embodiment is denoted by the same reference numeral as image processor 80, and the description is omitted or simplified.

As illustrated in FIG. 20, image processor 280 of liquid crystal display device 210 includes second temporal filter 286 in addition to image processor 80 of the first exemplary embodiment. Parallax reduction unit 84 and second temporal filter 286 constitute the first parallax reduction unit.

Second temporal filter 286 is connected among parallax reduction unit 84, first temporal filter 85, and second liquid crystal panel 30. In other words, the signal output from second temporal filter 286 is input to first temporal filter 85 and second liquid crystal panel 30 as second output image signal DAT2.

Second temporal filter 286 generates the second response correction signal preventing the generation of the flicker and the luminance unevenness due to the temperature change. The second response correction signal is a signal based on the signal from parallax reduction unit 84, and is a signal delaying the response of second liquid crystal panel 30. It can be said that the second response correction signal is a signal delaying the response of the display image on second liquid crystal panel 30 (specifically, delaying the response in the low-frequency region of the display image of second liquid crystal panel 30). For example, the second response correction signal is a signal obtained by delaying the luminance change of the low-frequency component in the signal from the parallax reduction unit.

Second temporal filter 286 generates the current-frame second response correction signal using the signal output from parallax reduction unit 84. It can be said that second temporal filter 286 generates the current-frame second response correction signal using the signal subjected to the low-pass filtering processing. Second temporal filter 286 generates the current-frame second response correction signal by performing the filtering processing in the temporal direction using the signal from parallax reduction unit 84 and the second response correction signal (an example of the output signal) output from second temporal filter 286 to first temporal filter 85 and second liquid crystal panel 30 in the past frame. In the third exemplary embodiment, second output image signal DAT2 is the current-frame second response correction signal.

Consequently, the sudden change in luminance value can be prevented in second liquid crystal panel 30. Specifically, second temporal filter 286 prevents the temporal change of the luminance in the low-frequency region of the sub display image displayed on second liquid crystal panel 30.

The filtering processing of second temporal filter 286 will be described below. Assuming that VI3*n*(i, j) is a signal from parallax reduction unit 84 at pixel position (i, j) of the n-th frame, that VO3*n*−1(i, j) is the output data (an example of the past-frame second response correction signal) of second temporal filter 286 at pixel position (i, j) of the (n−1)-th frame, and that K5 is time constant, output data VO3*n*(i, j) of second temporal filter 286 at pixel position (i, j) of the n-th frame is given by the following equation 10

$$VO3n(i,j)=\{VI3n(i,j)-VO3n-1(i,j)\}\times K5+VO3n-1(i,j) \quad \text{equation 10)}$$

As illustrated in the equation 10, second temporal filter 286 calculate the current-frame input data (an example of the current-frame second response correction signal) using the current-frame input data (that is the signal from parallax reduction unit 84, and an example of the first parallax reduction signal) and the past-frame output data (an example of the past-frame second response correction signal). In other words, second temporal filter 286 performs such the processing that the past-frame output data affects the current-frame output data. In the third exemplary embodiment, second temporal filter 286 is configured such that the previous-frame output data affects the next-frame output data.

For example, time constant K5 of second temporal filter 286 is set to a value smaller than 1. Second temporal filter 286 performs the filtering processing so as to delay the response of second liquid crystal panel 30. As described above, second temporal filter 286 adjusts the value of time constant K5 to bring the difference in response between first liquid crystal panel 20 and second liquid crystal panel 30 close to zero even when the temperature changes.

For example, the response speeds of first liquid crystal panel 20 and second liquid crystal panel 30 are measured, and time constant K5 may previously be set based on the measurement result. For example, time constant K5 may be set to a predetermined value. Time constant K5 is an example of the filter coefficient.

For example, the low-pass filter having the IIR filter configuration can be applied to second temporal filter 286. For example, second temporal filter 286 may be the low-pass filter having the IIR filter configuration of the first-order lag system. Second temporal filter 286 is not limited to the low-pass filter having the IIR filter configuration. For example, second temporal filter 286 may be a low-pass filter having an FIR filter configuration. For example, second temporal filter 286 may be a median filter or the like.

Image processor 280 includes a frame memory (not illustrated) that stores the output data of second temporal filter 286 in the past frame. For example, second temporal filter 286 may include the frame memory.

Second temporal filter 286 is not limited to the use of the approximate equation such as the equation 10. For example, second temporal filter 286 may generate the current-frame second response correction signal by calculating the output value using the look-up table.

Image processor 280 having the above configuration slowly changes the gradation value in the low-frequency region of second output image signal DAT2 output to second liquid crystal panel 30 by the filtering processing of second temporal filter 286. As a result, the low-frequency region of the sub display image displayed on second liquid crystal panel 30 changes slowly.

Corrector 90 corrects first output image signal DAT1 while maintaining a relationship that input image signal Data is obtained by multiplying first output image signal DAT1 and second output image signal DAT2. Specifically, corrector 90 performs the correction so as to slowly change the gradation value in the low-frequency region of first output image signal DAT1 output to first liquid crystal panel 20.

Consequently, in liquid crystal display device 210, even when the response difference of the response speed between first liquid crystal panel 20 and second liquid crystal panel 30 changes due to the temperature change, the generation of the flicker and the luminance unevenness due to the temperature change can be prevented by slowly changing the luminance values in the low-frequency regions of first liquid crystal panel 20 and second liquid crystal panel 30.

When parallax reduction unit 84 has the large filter size (for example, 300 pixels×300 pixels), second temporal filter 286 can further prevent the generation of the flicker and the luminance unevenness due to the low-pass filtering processing of parallax reduction unit 84.

As described above, the first parallax reduction unit includes the low-pass filter that generates the first parallax reduction signal by performing the smoothing processing on the second gamma correction signal and second temporal filter 286 that generates current-frame second output image signal DAT2 by performing the filtering processing in the temporal direction based on the first parallax reduction signal and past-frame second output image signals DAT2.

The low-pass filter is an example of the smoothing filter, and the first parallax reduction signal is an example of the parallax reduction signal. Parallax reduction unit 84 includes the smoothing filter. Parallax reduction unit 84 and second temporal filter 286 constitute the first parallax reduction unit.

Consequently, second temporal filter 286 can delay the low-frequency region of the signal from parallax reduction unit 84. That is, second temporal filter 286 is included, which slowly switches the display of second liquid crystal panel 30 in the low-frequency region. Along with this, the display on first liquid crystal panel 20 is also slowly switched in the low-frequency region by the correction of corrector 90. Thus, even when the response difference between first liquid crystal panel 20 and second liquid crystal panel 30 changes due to the temperature change, liquid crystal display device 210 can prevent the generation of the flicker and the luminance unevenness due to the temperature change by the slow switching of the display in the low-frequency region. That is, in liquid crystal display device 210, the degradation of the image quality can further be prevented without adding another configuration such as a temperature sensor, namely, while the cost increase is prevented.

Other Exemplary Embodiments

Although the liquid crystal display devices of each embodiment and modification (hereinafter, also referred to as the embodiments and the like) are described above, the present disclosure is not limited to the embodiments.

In the embodiments and the like, by way of example, the liquid crystal display device includes two liquid crystal panels. However, the present disclosure is not limited thereto. For example, the liquid crystal display device may include three or more liquid crystal panels.

In the embodiments and the like, the glass substrate is used as the pair of first transparent substrates and the pair of second transparent substrates. However, the present disclosure is not limited thereto, and a transparent resin substrate or the like may be used.

Division of the functional blocks in the block diagram is by way of example, and a plurality of functional blocks may be implemented as one functional block, a single functional block may be divided into the plurality of functional blocks, or some functions may be transferred to another functional block. The functions of the plurality of functional blocks having similar functions may be processed in parallel or in a time-division manner by single hardware or software.

In the embodiments and the like, each component may be constructed with dedicated hardware, or implemented by executing a software program suitable for each component. Each component may be implemented by causing a program execution unit such as a processor to read and execute a software program recorded in a recording medium such as a hard disk and a semiconductor memory. The processor is configured with one or a plurality of electronic circuits including a semiconductor integrated circuit (IC) or a Large Scale Integration (LSI). The plurality of electronic circuits may be integrated in one chip, or provided in a plurality of chips. A plurality of chips may be integrated in one device, or provided in a plurality of devices.

The order of the plurality of pieces of processing described in the embodiments and the like is an example. The order of the plurality of pieces of processing may be changed, or the plurality of pieces of processing may be performed in parallel.

Those skilled in the art will readily appreciate that many modifications are possible in the above exemplary embodiment and variations without materially departing from the novel teachings and advantages of the present disclosure. Accordingly, all such modifications are intended to be included within the scope of the present disclosure.

What is claimed is:

1. A liquid crystal display device comprising:

a first liquid crystal panel;

a second liquid crystal panel disposed to be superposed on the first liquid crystal panel; and an image processor that generates a first output image signal output to the first liquid crystal panel and a second output image signal output to the second liquid crystal panel based on an input image signal, wherein the image processor includes:

a first parallax reduction unit that receives a first signal based on the input image signal, and generates the second output image signal by performing smoothing processing on the first signal;

a first temporal filter that receives the second output image signal, and generates a first response correction signal determining the first output image signal based on the second output image signal; and a corrector that receives at least the first response correction signal and a second signal based on the input image signal, and generates the first output image signal based on at least the first response correction signal and the second signal, and the first temporal filter generates the first response correction signal of a current frame based on the second output image signal of the current frame and the first response correction signal of a previous frame.

2. The liquid crystal display device according to claim 1, wherein the first signal is also input to the corrector, and the corrector includes:

a division processor that calculates a correction value based on the first signal and the first response correction signal; and a multiplier that generates the first output image signal based on the correction value and the second signal.

3. The liquid crystal display device according to claim 1, wherein the first temporal filter performs filtering processing using a filter coefficient corresponding to a difference in response speed between the first liquid crystal panel and the second liquid crystal panel.

4. The liquid crystal display device according to claim 1, wherein the first temporal filter performs filtering processing using a conversion table in which an input value of the second output image signal, an output value of the first response correction signal of the previous frame, and an output value of the first response correction signal of the current frame are associated with each other.

5. The liquid crystal display device according to claim 1, further comprising:

a second parallax reduction unit that generates a second parallax reduction signal by performing correction reducing a parallax on a third signal based on the input image signal;

a second temporal filter that generates a second response correction signal of the current frame, the second response correction signal delaying a response speed of the second liquid crystal panel, by performing filtering processing in a temporal direction using the second parallax reduction signal and the second response correction signal of the past frame; and a blending unit that generates the first signal by adding the third signal and the second response correction signal of the current frame with a predetermined weight.

6. The liquid crystal display device according to claim 5, wherein the second parallax reduction unit has a filter size larger than that of the first parallax reduction unit.

7. The liquid crystal display device according to claim 5, wherein the blending unit determines the predetermined weight according to brightness of an image indicated by the input image signal.

8. The liquid crystal display device according to claim 7, wherein the blending unit determines the predetermined weight such that a weight of the second response correction signal of the current frame becomes larger than the third signal when the image has brightness greater than or equal to predetermined brightness, and the blending unit determines the predetermined weight such that a weight of the third signal becomes larger than the third signal when the brightness of the image indicated by the input image signal is lower than the predetermined brightness.

9. The liquid crystal display device according to claim 5, further comprising a gradation corrector that generates the third signal by correcting a gradation value of the input image signal in accordance with a gamma characteristic of the second liquid crystal panel.

10. The liquid crystal display device according to claim 1, wherein the first parallax reduction unit includes:

a smoothing filter that generates a parallax reduction signal by performing the smoothing processing on the first signal; and a second temporal filter that generates the second output image signal of the current frame by performing filtering processing in a temporal direction based on the parallax reduction signal and the second output image signal of the previous past frame.

11. The liquid crystal display device according to claim 1, further comprising a gradation corrector that generates the first signal by correcting a gradation value of the input image signal in accordance with a gamma characteristic of the second liquid crystal panel.

12. The liquid crystal display device according to claim 1, wherein the second signal is the input image signal.

13. The liquid crystal display device according to claim 1, wherein the first liquid crystal panel displays a color image, and the second liquid crystal panel is disposed on a rear side of the first liquid crystal panel to display a monochrome image.

* * * * *